US010527999B2

(12) United States Patent
Koyama et al.

(10) Patent No.: US 10,527,999 B2
(45) Date of Patent: Jan. 7, 2020

(54) CARTRIDGE UNIT AND IMAGE FORMING APPARATUS HAVING FEATURES TO PREVENT ERRONEOUS CARTRIDGE UNIT LOCKING

(71) Applicant: CANON KABUSHIKI KAISHA, Tokyo (JP)

(72) Inventors: Hiroshi Koyama, Matsudo (JP); Ryota Yasui, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/989,312

(22) Filed: May 25, 2018

(65) Prior Publication Data

US 2018/0348694 A1 Dec. 6, 2018

(30) Foreign Application Priority Data

Jun. 2, 2017 (JP) ..... 2017-110447

(51) Int. Cl.
*G03G 15/00* (2006.01)
*G03G 21/18* (2006.01)

(52) U.S. Cl.
CPC ..... *G03G 15/751* (2013.01); *G03G 21/185* (2013.01); *G03G 21/1842* (2013.01)

(58) Field of Classification Search
CPC ..... G03G 15/751
USPC ..... 399/117
See application file for complete search history.

(56) References Cited

U.S. PATENT DOCUMENTS

| | | | | |
|---|---|---|---|---|
| 6,980,756 | B2 | 12/2005 | Kubota | |
| 7,532,741 | B2 | 5/2009 | Stach | |
| 9,886,001 | B2 | 2/2018 | Katsumata | |
| 2009/0080935 | A1* | 3/2009 | Iikura | G03G 21/1832 399/114 |
| 2016/0209803 | A1* | 7/2016 | Katayama | G03G 21/1661 |

FOREIGN PATENT DOCUMENTS

| | | | |
|---|---|---|---|
| JP | 2004-125954 | A | 4/2004 |
| JP | 2016-130816 | A | 7/2016 |
| JP | 2016-136219 | A | 7/2016 |

OTHER PUBLICATIONS

Co-pending U.S. Appl. No. 15/989,303.

* cited by examiner

*Primary Examiner* — Walter L Lindsay, Jr.
*Assistant Examiner* — Philipmarcus T Fadul
(74) *Attorney, Agent, or Firm* — Venable LLP

(57) ABSTRACT

An image forming apparatus includes a first apparatus body, a first drum cartridge, a first guide portion, a lock unit, and a first erroneous insertion blocking portion. The lock unit is configured to lock a first cover member with the first apparatus body if the first drum cartridge with the first cover member is inserted by a first distance from a first insertion slot portion by being guided by the first guide portion. The first erroneous insertion blocking portion is configured to permit the first drum cartridge to be inserted into the first apparatus body and to block a second drum cartridge, functionally different from the first drum cartridge, to be inserted into the first apparatus body in a range exceeding a third distance shorter than a first distance from the first insertion slot portion.

9 Claims, 25 Drawing Sheets

CARTRIDGE UNIT AND IMAGE FORMING APPARATUS HAVING FEATURES TO PREVENT ERRONEOUS CARTRIDGE UNIT LOCKING

BACKGROUND OF THE INVENTION

Field of the Invention

The present invention relates to an electro-photographic or electrostatic recording image forming apparatus utilizing a cartridge type photosensitive member.

Description of the Related Art

Hitherto, an electro-photographic image forming apparatus is configured to visualize an image by developing an electrostatic latent image formed on an image bearing member such as a photosensitive drum by resin containing coloring matters and others. Popular one among such image forming apparatuses is an image forming apparatus configured to unitize a photosensitive drum, i.e., a photosensitive member, as a cartridge, to enable the cartridge to be mounted to an apparatus body as a process cartridge or as a drum cartridge and to enable a user of the apparatus to replace the cartridge as an image forming member. It is noted that the process cartridge or the drum cartridge in which the photosensitive drum is unitized as the cartridge will be called collectively as a drum cartridge.

In order to improve workability in replacing such drum cartridge, Japanese Patent Application Laid-open No. 2016-130816 proposes an image forming apparatus configured to be able to mount the following drum cartridge. In this image forming apparatus, a cover member for protecting the photosensitive drum is attached to the new drum cartridge to be mounted to the image forming apparatus. In mounting the drum cartridge to the apparatus body, a user inserts a front end portion of the cover member into the apparatus body to be held by the apparatus body. The cover member and the apparatus body are provided respectively with guide portions configured to slidably guide the drum cartridge. The guide portion on the cover member side and the guide portion on the apparatus body side are aligned by engaging the cover member with the apparatus body. In this condition, the drum cartridge is passed from the guide portion on the cover member side to the guide portion on the apparatus body side by pressing the drum cartridge heled by the cover member into the apparatus body side by the user. In a case where the drum cartridge is inserted into the apparatus body by a first distance from an insertion starting position of the apparatus body, the apparatus body and the cover member are locked, and only the drum cartridge is inserted into the apparatus body while locking the cover member with the apparatus body.

After that, in a case where the drum cartridge is inserted into the apparatus body further and arrives at a second distance, the cover member is unlocked from the apparatus body. This arrangement makes it possible to suppress the photosensitive drum from being unnecessarily exposed and to suppress the photosensitive drum from coming into contact with the apparatus body during the drum cartridge replacing works because the drum cartridge is covered by the cover member during the drum cartridge replacing works. Still further, because the cover member is removed after mounting the drum cartridge to the apparatus body, the workability in replacing the drum cartridge is improved.

By the way, in a case where there are two types of apparatus bodies having different specifications for example, two kinds of drum cartridges having different functions of storing photosensitive drums functionally compatible with the respective apparatus bodies are prepared. At this time, there is a case where cover members of the two types of drum cartridges having the different functions are commonly used. Here, if it becomes possible for the user to replace the drum cartridge by adopting a drum cartridge replaceable with respect to the apparatus body, there is a possibility that the user erroneously inserts a drum cartridge whose cover member is identical in shape even though it is not compatible functionally with the apparatus body. Even if the user erroneously inserts such drum cartridge, there is a possibility that the user executes an image forming operation without noticing on that the drum cartridge is wrong if the shapes of the cover members and couplings are identical. In order to prevent such erroneous insertion of the drum cartridge into the apparatus body, Japanese Patent Application Laid-open No. 2004-125954 proposes an image forming apparatus provided with an erroneous insertion blocking portion that permits only a drum cartridge functionally compatible with the apparatus body to be inserted into the apparatus body. In order to prevent such erroneous insertion, this image forming apparatus is provided with uneven shaped portions for example in the apparatus body and the drum cartridge such that the uneven shaped portions interfere with each other if a wrong drum cartridge is to be inserted into the apparatus body.

However, because the drum cartridge can be inserted into the apparatus body in the image forming apparatus disclosed in Japanese Patent Application Laid-open No. 2016-130816 described above, there is a possibility that the user erroneously inserts the drum cartridge functionally incompatible with the apparatus body into the apparatus body as it is. In order to prevent such an erroneous operation, if the erroneous insertion blocking portion described in Japanese Patent Application Laid-open No. 2004-125954 is simply applied to the image forming apparatus described in Japanese Patent Application Laid-open No. 2016-130816, the following problems may occur. For instance, if the erroneous insertion blocking portion becomes operative in a case where the drum cartridge is located between the first distance where the cover member is locked by the apparatus body and the second distance where the cover member is unlocked from the apparatus body, the drum cartridge cannot be inserted into the second distance. Thereby, the cover member cannot be unlocked from the apparatus body, and depending on a configuration of the apparatus body, there is a possibility that the drum cartridge cannot be taken out of the apparatus body.

The present disclosure aims at providing an image forming apparatus which is configured to lock a cover member to an apparatus body in inserting a drum cartridge into the apparatus body and which is configured to prevent the cover member from being locked in a case where a drum cartridge functionally incompatible with the apparatus body is disabled to be inserted by an erroneous insertion blocking portion.

SUMMARY OF THE INVENTION

According to a first aspect of the present invention, an image forming apparatus includes a first apparatus body with a first insertion slot portion, a first drum cartridge which is functionally compatible with the first apparatus body, which comprises a photosensitive drum for forming an image, and with which a first cover member is removably attached before the first drum cartridge is mounted to the first apparatus body, the first drum cartridge being capable of inserting into the first apparatus body in an insert direction and of being pulled out of the first apparatus body in a pull-out direction opposite to the insert direction, the first cover member being configured to shade the photosensitive drum, a first guide portion configured to guide the first drum cartridge in a case where the first drum cartridge with the first cover member is inserted into the first apparatus body from the first insertion slot portion, the first guide portion being compatible in shape with the first drum cartridge and a second drum cartridge functionally different from the first drum cartridge, a lock unit configured to lock the first cover member with the first apparatus body if the first drum cartridge with the first cover member is inserted by a first distance from the first insertion slot portion by being guided by the first guide portion, and to unlock the first cover member from the first apparatus body if the first drum cartridge is inserted by a second distance which is longer than the first distance by being guided by the first guide portion from the first insertion slot portion, and a first erroneous insertion blocking portion configured to permit the first drum cartridge to be inserted into the first apparatus body and to block the second drum cartridge to be inserted into the first apparatus body in a range exceeding a third distance shorter than the first distance from the first insertion slot portion. The first drum cartridge is compatible in shape with a second guide portion which is compatible in shape with the second drum cartridge and is blocked by a second erroneous insertion blocking portion if the first drum cartridge is inserted into a second apparatus body in which the second guide portion is provided. The second drum cartridge is guided by the second guide portion in a case where the second drum cartridge is mounted into the second apparatus body from a second insertion slot portion, and the second erroneous insertion blocking portion is permits the second drum cartridge to be inserted into the second apparatus body.

According to a second aspect of the present invention, an image forming apparatus includes a first apparatus body with a first insertion slot portion, a first drum cartridge which is functionally compatible with the first apparatus body, which comprises a photosensitive drum for forming an image, and with which a first cover member is removably attached before the first drum cartridge is mounted to the first apparatus body, the first drum cartridge being capable of inserting into the first apparatus body in an insert direction and of being pulled out of the first apparatus body in a pull-out direction opposite to the insert direction, the first cover member being configured to shade the photosensitive drum, a first guide portion configured to guide the first drum cartridge in a case where the first drum cartridge with the first cover member is inserted into the first apparatus body from the first insertion slot portion, the first guide portion being compatible in shape with the first drum cartridge and a second drum cartridge functionally different from the first drum cartridge, a lock unit configured to lock the first cover member with the first apparatus body if the first drum cartridge with the first cover member is inserted by a first distance from the first insertion slot portion by being guided by the first guide portion, and to unlock the first cover member from the first apparatus body if the first drum cartridge is inserted by a second distance which is longer than the first distance by being guided by the first guide portion from the first insertion slot portion, a first portion provided in the first guide portion, and a second portion provided outside of the first drum cartridge. The first and second portions are disposed such that an end face in the pull-out direction of the first portion matches with an end face in the insert direction of the second portion when viewed in one of directions orthogonal to the insert direction and such that the first and second portions do not overlap when viewed in the insert direction in a case where the first drum cartridge is inserted by a third distance which is shorter than the first distance from the first insertion slot portion. The second portion is disposed such that an end face in the pull-out direction of a third portion provided in a second guide portion matches with an end face in the insert direction of the second portion when viewed in one of directions orthogonal to the insert direction and such that the third portion overlaps with the second portion when viewed in the insert direction in a case where the first drum cartridge is inserted into a second apparatus body functionally different from the first apparatus body by the third distance from a second insertion slot portion of the second apparatus body. The first portion is disposed such that an end face in the pull-out direction of the first portion matches with an end face in the insert direction of a fourth portion provided outside of the second drum cartridge and that permits a second drum cartridge from being inserted into the second apparatus body without butting against the third portion in a case where the second drum cartridge is inserted into the second apparatus body when viewed in one of directions orthogonal to the insert direction and such that the first portion overlaps with the fourth portion when viewed in the insert direction in a case where the second drum cartridge functionally different from the first drum cartridge is inserted by the third distance from the first insertion slot portion.

Further features of the present invention will become apparent from the following description of exemplary embodiments with reference to the attached drawings.

DESCRIPTION OF THE EMBODIMENTS

Figure 1:
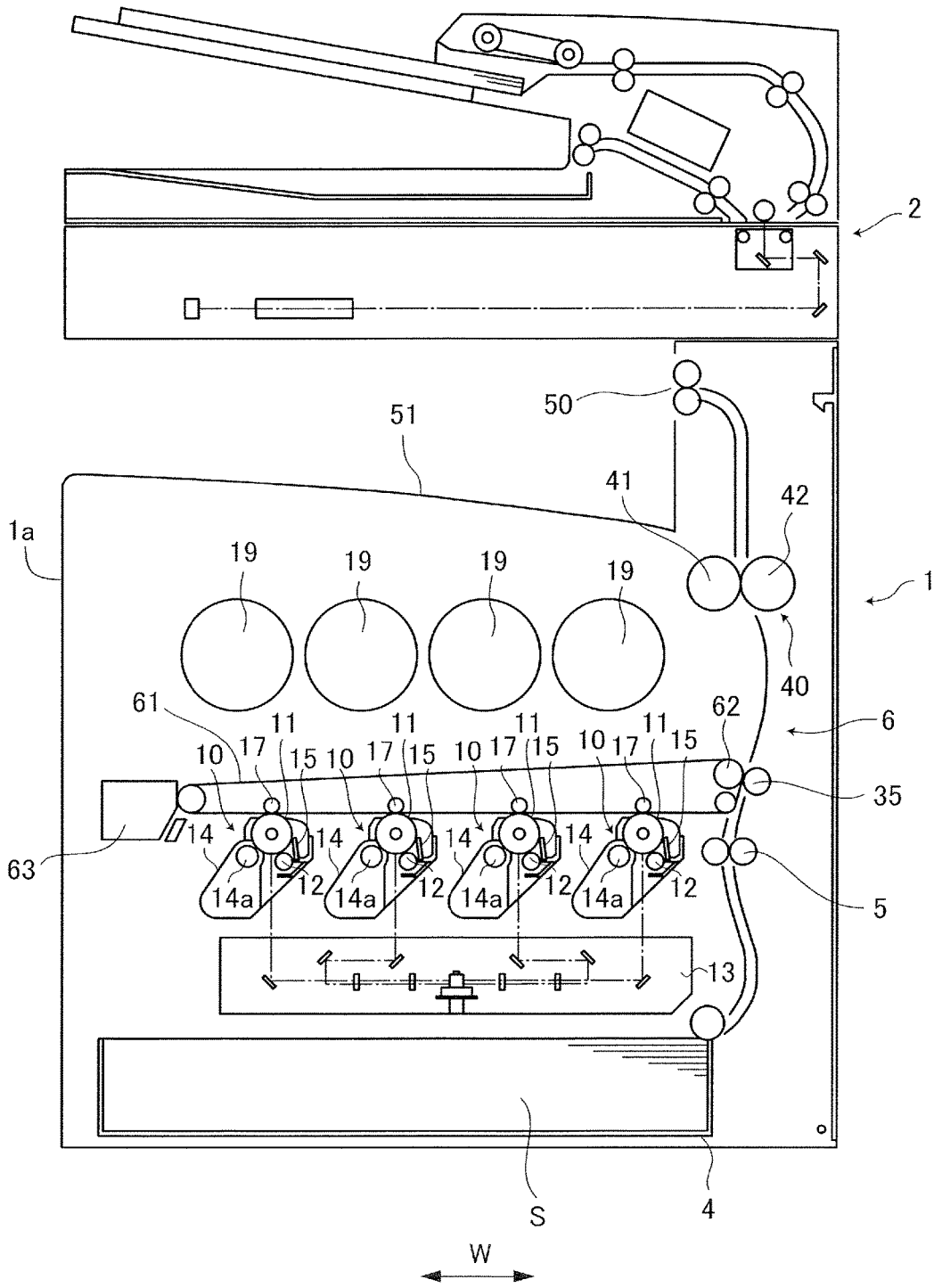
FIG. 1 is a section view illustrating a schematic configuration of an image forming apparatus of embodiment of the present disclosure.

An image forming apparatus 1 of an embodiment of the present disclosure will be described in detail below with reference to FIGS. 1 through 25C. It is noted that while a tandem type full-color printer will be described as an exemplary image forming apparatus in the present embodiment, the image forming apparatus of the present disclosure is not limited to be the tandem type image forming apparatus and may be another type image forming apparatus. The image forming apparatus is not also limited to be the full-color printer and may be a monochrome or mono-color printer. Or, the present disclosure may be carried out in various uses such as a printer, various printing machines, a copier, a facsimile machine, a multi-function printer and the like by adding a necessary device, equipment and or a casing structure.

The image forming apparatus 1 of the present embodiment includes an intermediate transfer belt 61 and adopts a secondary transfer system of primarily transferring toner images of respective colors from a photosensitive drum 11 to the intermediate transfer belt 61 and of then secondarily transferring a composite toner images of the respectively colors collectively onto a sheet S. However, the present disclosure is not limited to such system and may adopt a system of directly transferring a toner image from a photosensitive drum onto a sheet conveyed by a sheet conveyance belt. Two-component developer which is a mixture of non-magnetic toner and magnetic carrier is used as developer in the present embodiment. The sheet S serving as a recording material is what the toner image is formed thereon and is specifically a plain sheet of paper, a resin sheet as a substitute of the sheet of paper, a thick sheet, an overhead projector sheet or the like.

Image Forming Apparatus

The image forming apparatus 1 includes image forming portions 10 of each color of Y (yellow), M (magenta), C (cyan) and K (black). The image forming apparatus 1 of the present embodiment is of a so-called tandem type configuration in which the image forming portions 10 of the respective colors are arrayed in a rotation direction of the intermediate transfer belt 61. The image forming portion 10 of each color performs an image forming process as follows. After a surface of the photosensitive drum 11 serving as an image bearing member is homogenously charged by the charging roller 12, a latent image is formed on the surface by a laser scanner 13 driven based on a signal of transmitted image information. It is noted that the image forming apparatus 1 of the present embodiment includes an image reading unit 2, and the image information described above includes image information of a document read by the image reading unit 2 and image information sent from an external terminal such as a personal computer connected with the image forming apparatus 1.

The latent image formed on the photosensitive drum 11 as described above is visualized as a toner image by a developing apparatus 14, and the toner image corresponding to each color is formed on the photosensitive drum 11. That is, the developing apparatus 14 includes a developer sleeve 14*a* serving as a developer bearing member at a position facing the photosensitive drum 11. The developer sleeve 14*a* rotates while bearing the developer within the developing apparatus 14 and supplies toner to the photosensitive drum 11 by a predetermined developing bias applied between the developer sleeve 14*a* and the photosensitive drum 11 to develop the latent image by the toner.

Toner images formed respectively on the photosensitive drums 11 of the respective colors are transferred sequentially onto the intermediate transfer belt 61 by a predetermined pressure and an electrostatic load bias applied by a primary transfer roller 17. After the transfer, residual toner slightly left on the photosensitive drum 11 is removed and collected by a cleaning blade 15 to be ready for a next image forming operation. Because the toner within the developing apparatus 14 is consumed by thus forming the image, toner is replenished from a toner cartridge 19 to the developing apparatus 14.

Meanwhile, the sheet S is fed one by one from a sheet feed cassette 4 and is conveyed to a registration roller pair 5. A skew of the sheet S is corrected by forming a loop such that a front edge follows a nip portion of the registration roller pair 5. After that, the registration roller pair 5 conveys the sheet S between the intermediate transfer belt 61 and a secondary transfer outer roller 35 by synchronizing with the toner image on the intermediate transfer belt 61. The toner image on the intermediate transfer belt 61 is transferred onto the sheet S by a predetermined pressure and an electrostatic load bias applied at the nip portion between a driving roller 62 and the secondary transfer outer roller 35 disposed opposite to each other. After the transfer, slight residual toner left on the intermediate transfer belt 61 is removed and collected by a cleaning unit 63 to be ready for a next image forming operation.

The toner image that has been transferred onto the sheet S is fixed by heat and pressure applied by a heating roller 41 and a pressure roller 42 of a fixing unit 40. The sheet S onto which the toner image has been transferred is conveyed by the recording material conveyance portion 6 and is discharged onto a discharge tray 51 by a discharge roller pair 50. The image forming apparatus 1 of the present embodiment has a so-called in-trunk delivery configuration in which the discharge tray 51 is provided between the apparatus body 1*a*, in which the image forming portion 10, the intermediate transfer belt 61, the fixing unit 40 and others are disposed, and the image reading unit 2.

While an apparatus body 1*a* of the present embodiment is provided with the drum cartridges of yellow, magenta, cyan and black and developing apparatuses as described below and functions as a color image forming apparatus, the embodiment is not limited to such configuration. For instance, the apparatus body 1*a* of the embodiment may be provided with the black drum cartridge and the developing apparatus without the drum cartridges and the developing apparatuses of yellow, magenta and cyan to use as a monochrome image forming apparatus.

Drum Cartridge

Figure 2A:
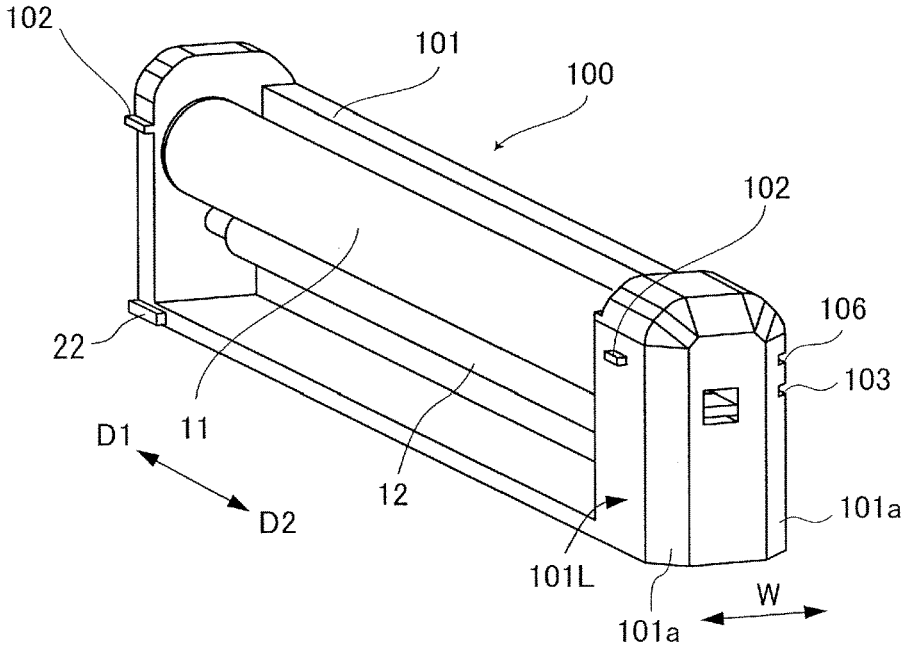
FIG. 2A is a perspective view illustrating a drum cartridge of the embodiment.
Figure 2B:
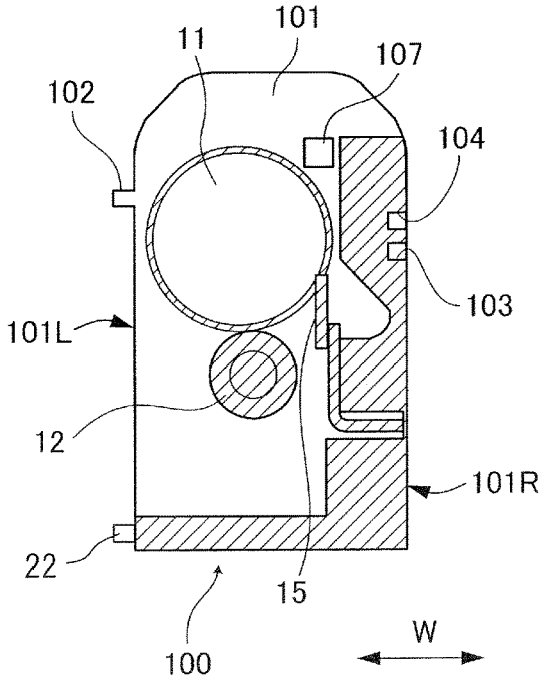
FIG. 2B is a section view of the drum cartridge of the embodiment.

In a case of the present embodiment, a first drum cartridge (referred to simply as a 'cartridge') 100 storing the photosensitive drum 11 serving also as an image forming member for forming an image is configured to be replaceable by enabling to be removably mounted to the apparatus body, i.e., a first apparatus body, 1*a*. As illustrated in FIGS. 2A and 2B, the cartridge 100 includes the photosensitive drum 11, the charging roller 12 and the cleaning blade 15 which are supported integrally by a housing 101. The photosensitive drum 11 and the charging roller 12 are supported to be rotatable with respect to the housing 101 and the charging roller 12 and the cleaning blade 15 are supported while being pressed against the photosensitive drum 11. Here, the cartridge 100 is functionally compatible with the apparatus body 1*a*. That is, the photosensitive drum 11, the charging roller 12, the cleaning blade 15 and other of the cartridge 100 are what function appropriately by being mounted and used in the apparatus body la and can form an image.

The cartridge 100 illustrated in FIG. 2B includes a light guide 107. The light guide 107 is a lengthy member provided along a longitudinal direction of the photosensitive drum 11. The light guide 107 is supported by the housing 101. The light guide 107 has a function of transmitting light incident on a longitudinal edge in the longitudinal direction. The image forming apparatus 1 includes a luminous body, e.g., LED, not illustrated, and light incident from the luminous body to the light guide 107 exposes the surface of the photosensitive drum 11 at each position in the longitudinal direction of the photosensitive drum 11. The image forming apparatus 1 of the present embodiment is configured to be able to execute a destaticization control for destaticizing the photosensitive drum 11 in the image forming process. The destaticization control is an exposure control for discharging and eliminating electric charge left on the photosensitive layer of the photosensitive drum 11 in the image forming process. Charge carrier is generated in an entire area of a charge generating layer of the photosensitive member, and residual charge left on the charge generating layer is discharged by executing the destaticization control. Ununiformity of electric potential of the photosensitive drum 11 is eliminated by discharging the residual charge. It is noted that in a case when the apparatus body 1*a* is used as a monochrome image forming apparatus, no light guide body 107 needs to be provided in the cartridge for the monochrome image forming apparatus because the destaticization control is not essential. That is, no light guide 107 needs to be always provided in the cartridge to be mounted to the monochrome image forming apparatus in a case where the charge (drum memory) left on the photosensitive layer of the photosensitive drum 11 is caused by the toners of yellow, magenta and cyan transferred onto the intermediate transfer belt 61 upstream of the primary transfer portion of black in the rotation direction of the intermediate transfer belt 61.

Because the photosensitive drum 11, the charging roller 12 and the cleaning blade 15 deteriorate in response to an increase of number of images thus formed, the cartridge 100 needs to be replaced corresponding to an amount of prints. Accordingly, the cartridge 100 is configured to be able to be inserted in a front-rear direction, i.e., to a rear side of the apparatus body 1*a*, and to be able to be pulled out toward the front side such that the cartridge 100 can be replaced in a case where a service life thereof ends. It is noted that the front side of the apparatus body 1*a* is a side where a user can manipulate the image forming apparatus 1.

Figure 3:
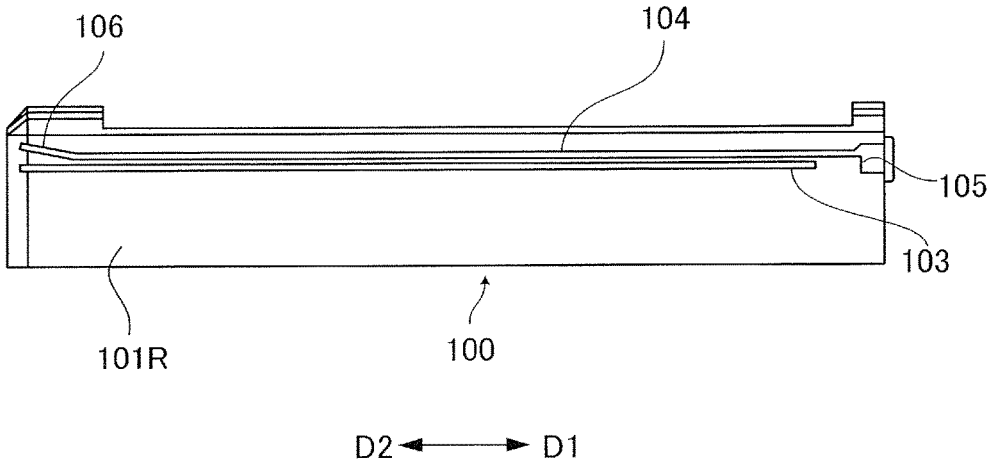
FIG. 3 is a side view of the drum cartridge of the embodiment.

Here, an insert direction is defined as a direction in which the cartridge 100 is inserted into the apparatus body 1*a*, i.e., an insert direction D1 indicated by an arrow in FIGS. 2A and 3. Still further, the pull-out direction is defined as a direction in which the cartridge 100 is pulled out of the apparatus body 1*a*, i.e., a pull-out direction D2 in an opposite direction of the insert direction D1 indicated by an arrow in FIGS. 2A and 3. That is, the cartridge 100 can be inserted into the apparatus body 1*a* in the insert direction D1 and can be pulled out of the apparatus body 1*a* in the pull-out direction D2. It is noted that a direction horizontally orthogonal to the insert direction D1 and the pull-out direction D2 will be defined as a width direction W.

By mounting the cartridge 100 into the apparatus body 1*a*, the photosensitive drum 11 is coupled with and driven by a drive transmission portion of a motor, which is a driving source not illustrated on the apparatus body 1*a* side, through a first coupling. Thereby, the photosensitive drum 11 is rotationally driven by the motor. Because the charging roller 12 is pressed against the photosensitive drum 11, the charging roller 12 rotates following the photosensitive drum 11. That is, in a case where the cartridge 100 is mounted to the apparatus body 1*a*, the first coupling couples the first driving source provided in the apparatus body 1*a* with the photosensitive drum 11 of the cartridge 100.

As illustrated in FIGS. 2A, 2B and 3, the housing 101 of the cartridge 100 is provided with a rib 102 and a guide 103 which are to be guided by a cover member 200 in inserting the cartridge 100 into the apparatus body 1*a*. As illustrated in FIGS. 2A and 2B, the ribs 102 are formed on one side surface 101L (left side surface in FIG. 2B) so as to protrude to the side at respective parts in the insert direction D1 and the pull-out direction D2 of the cartridge 100. As illustrated in FIGS. 2B and 3, the guide 103 is a groove defined on another side surface 101R (right side surface in FIG. 2B) of the housing 101 approximately in parallel with the insert direction D1.

Figure 6A:
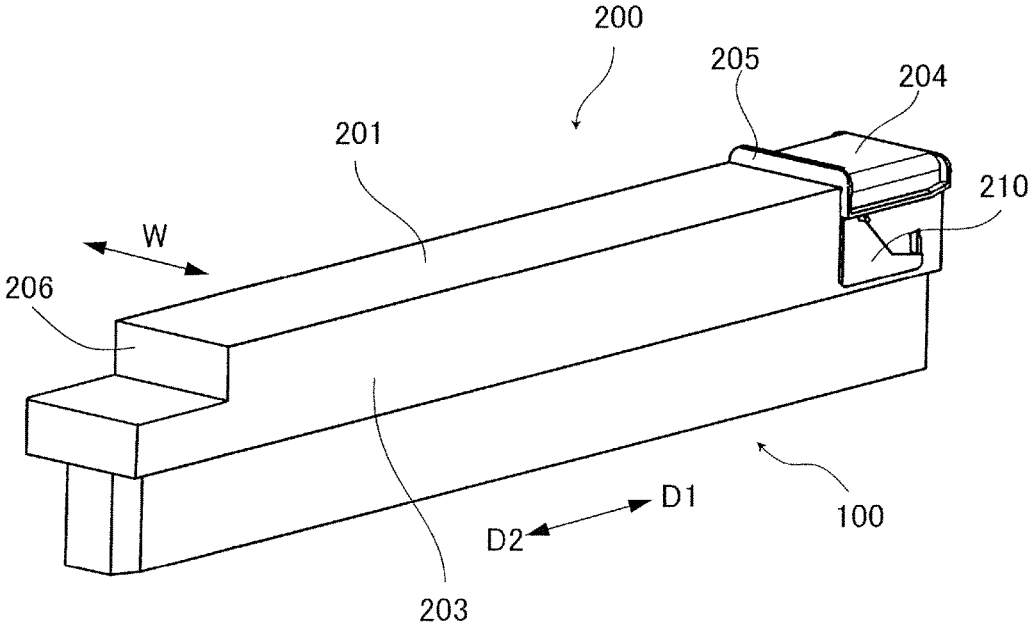
FIG. 6A is a perspective view illustrating a condition in which the cover member is attached to the drum cartridge of the embodiment.
Figure 6B:
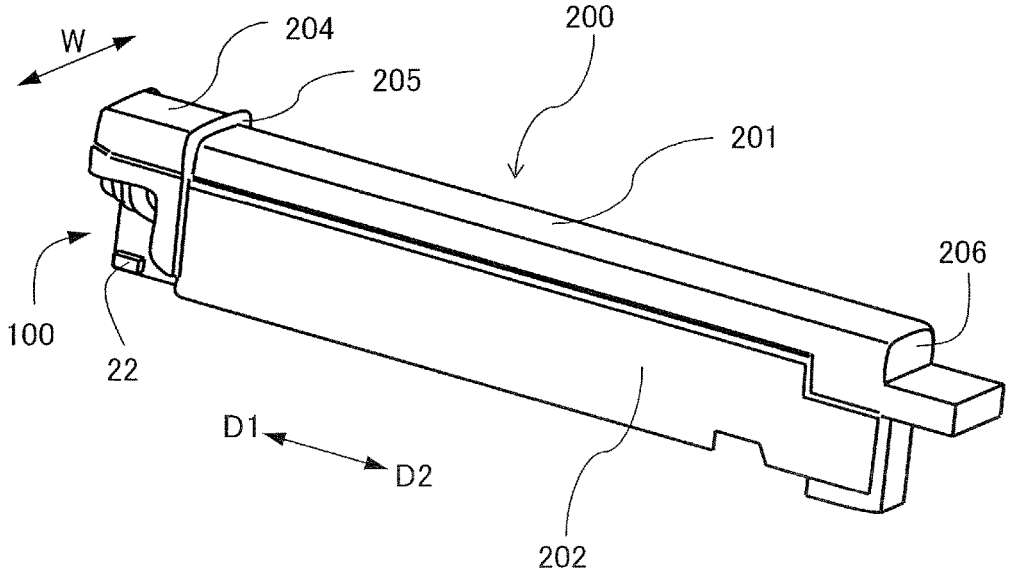
FIG. 6B is a perspective view illustrating the condition in FIG. 6A viewed from an angle direction different from that of FIG. 6A.

The cover member 200 for shading the photosensitive drum 11 is removably attached to the cartridge 100 before the cartridge 100 is mounted to the apparatus body 1*a* (see FIG. 6A). A groove-like lock guide portion 104 is defined adjacent the guide 103 along the insert direction D1 on the other side surface 101R of the housing 101. The lock guide portion 104 is defined engageably with a protrusion 211 formed on a swing plate 210 (see FIG. 17B and others) provided on the cover member 200 so as to engage and guide the protrusion 211. As illustrated in FIG. 3, defined at a front end portion in the insert direction D1 of the lock guide portion 104 (right end in FIG. 3) is a lock portion 105 whose width in a vertical direction is wider than a width of the lock guide portion 104 and which is provided with a level difference from the lock guide portion 104. Defined also at a front end portion in the pull-out direction D2 of the lock guide portion 104 (left end in FIG. 3) is a groove-like guide portion 106 inclined upward from the lock guide portion 104. The unlock guide portion 106, the lock guide portion 104 and the lock portion 105 are formed sequentially and continuously along the insert direction D1 and position a rotational phase of the swing plate 210 at each predetermined position by engaging with the protrusion 211 (see FIGS. 17A through 19B).

As illustrated in FIGS. 2A and 2B, the housing 101 of the cartridge 100 is provided with a second project portion 22 serving as a second portion formed at the front end portion in the insert direction D1. The second project portion 22 and a first project portion 21 described later compose an erroneous insertion blocking portion 20 (see FIGS. 13 through 14B). A detailed configuration of the erroneous insertion blocking portion 20 will be described later.

Cover Member

Figure 4A:
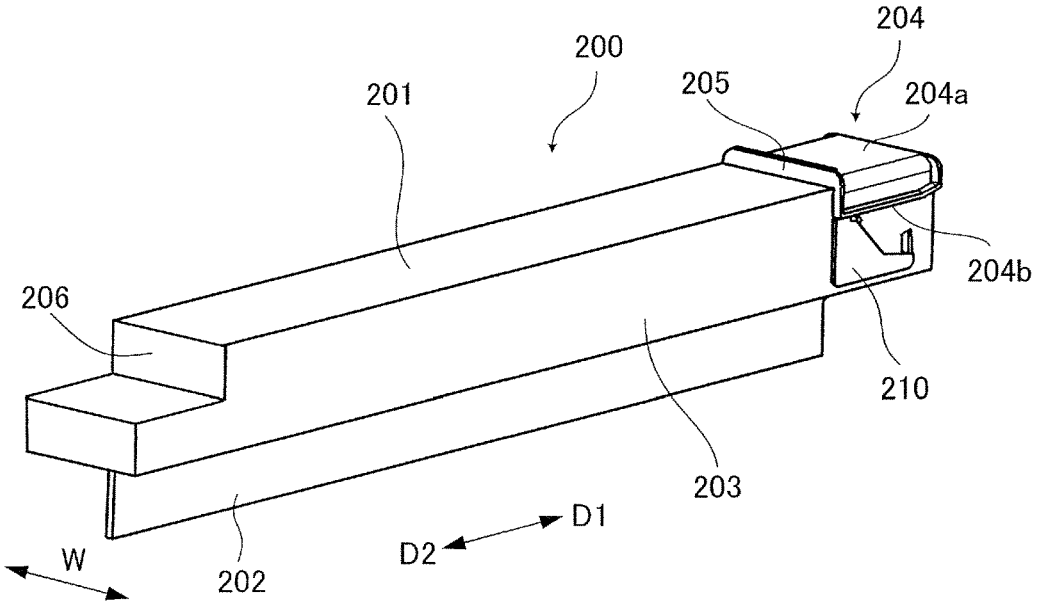
FIG. 4A is a perspective view of a cover member of the embodiment viewed from a side.

Before the cartridge 100 is mounted to the apparatus body 1*a*, the first cover member 200 (referred to simply as a 'cover member' hereinafter) for at least covering the photosensitive drum 11 is attached to the cartridge 100 to shade and protect members such as the photosensitive drum 11. As illustrated in FIG. 4A, the cover member 200 is formed approximately into a shape of a box which is long in the insert direction D1 of the cartridge 100 and whose front end side and a lower side in the insert direction D1 are opened. It is noted that while the insert direction D1 and the pull-out direction D2 are used as indicators of the directions also for the cover member 200 similarly to the cartridge 100 in the following description, these are directions in a condition in which the cover member 200 is attached to the cartridge 100.

As illustrated in FIGS. 4A through 5A, the cover member 200 includes a top plate portion 201, a first side plate 202 and a second side plate 203. The top plate portion 201, the first side plate 202 and the second side plate 203 function as a cover portion covering a photosensitive surface of the photosensitive drum before the cartridge 100 is mounted to the apparatus body 1*a*. The first and second side plates 202 and 203 are provided so as to project downward respectively from both widthwise ends of the top plate portion 201. In the present embodiment, a length in the vertical direction of the first side plate 202 is longer than that of the second side plate 203. This arrangement makes it possible for the first side plate 202 facing the developing apparatus 14 to adequately cover a side exposing in a wide range of the photosensitive drum 11.

Figure 4B:
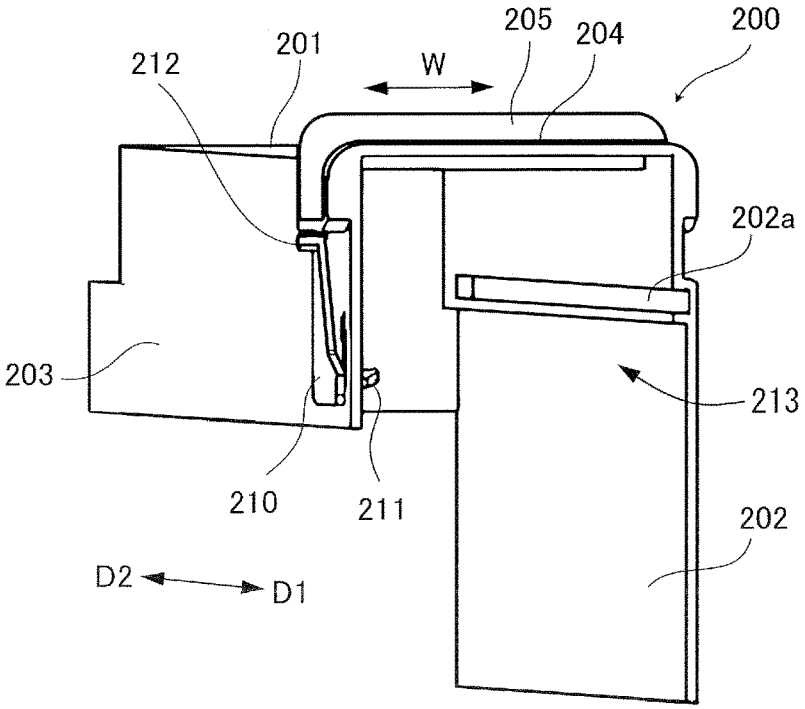
FIG. 4B is a perspective view of the cover member of the embodiment viewed from a front end side of an insert direction.
Figure 5A:
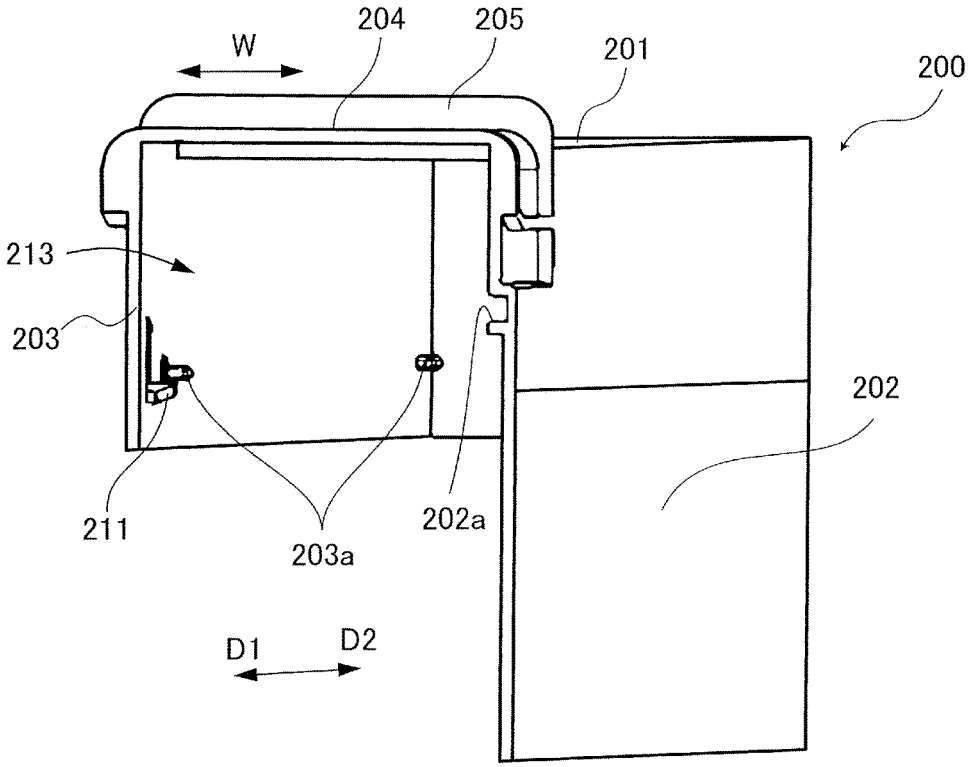
FIG. 5A is a perspective view of the cover member of the embodiment viewed from the front end side of the insert direction in an angle direction different from that of FIG. 4B.
Figure 5B:
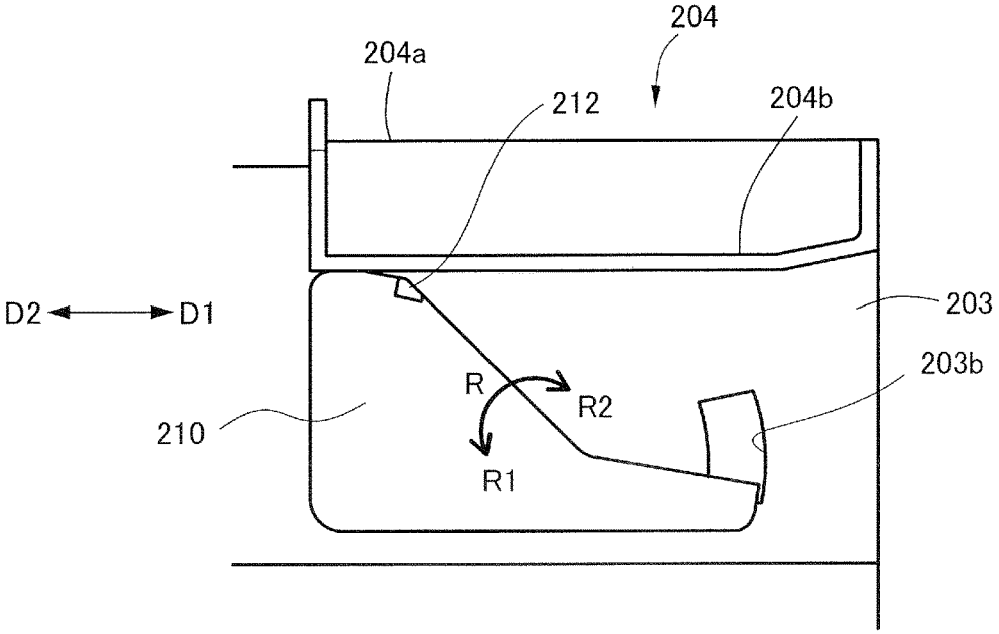
FIG. 5B is a side view illustrating the cover member of the embodiment by enlarging a part of the front end side of the insert direction.

As illustrated in FIG. 4B, the first side plate 202 is provided with a groove-like drum guide 202*a* defined on an inner side surface thereof along the insert direction D1. As illustrated in FIG. 5A, the second side plate 203 is provided with holding ribs 203*a* so as to project respectively at parts leaning both ends in the insert direction D1 of the inner side surface thereof.

Provided at the front end portion in the insert direction D1 of the cover member 200 is an insert portion 204 to be inserted into a predetermined position of the apparatus body 1*a*. The insert portion 204 includes an abutment surface 204*a* facing upward and an engage rib 204*b*. Provided at the pull-out direction D2 side of the insert portion 204 is a contact portion 205 that butts against a part of the apparatus body 1*a* in inserting into the apparatus body 1*a*. Provided at the front end side in the insert direction D1 of the cover member 200 is an opening 213 through which the cartridge 100 can be inserted/pulled out as illustrated in FIGS. 4B and 5A. As illustrated in FIG. 4A, the pull-out direction D2 side of the cover member 200 is covered by a rear side plate 206 so as to connect rear end portions of the second side plate 203 and the first side plate 202.

As illustrated also in FIGS. 4A through 5B, the swing plate 210 serving as a moving unit is disposed widthwise outside of the second side plate 203 at the front end side in the insert direction D1 of the second side plate 203. The swing plate 210 is provided swingably (movably) in a swing direction R in FIG. 5B with respect to the second side plate 203 centering on a swing shaft not illustrated and whose axial direction orients in the width direction W. It is noted that in FIG. 5B, a left-turn direction of the swing plate 210 is an unlock direction R1 and a right-turn direction is a lock direction R2. The swing plate 210 includes a front end portion and a base end portion. The front end portion in the insert direction D1 is formed such that a width in the vertical direction thereof is small, and the base end portion is formed such that a width in the vertical direction on the pull-out direction D2 side is large.

Figure 17A:
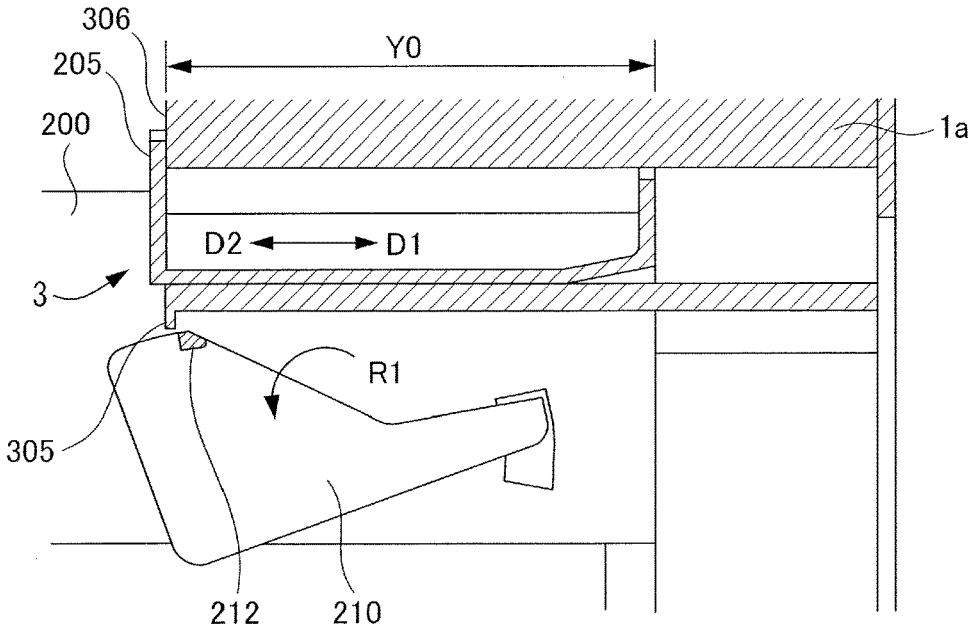
FIG. 17A is a section view illustrating the relationship between the engage portion of the swing plate and the projecting portion of the apparatus body in a condition of a third step of mounting the drum cartridge of the present embodiment to the apparatus body.
Figure 17B:
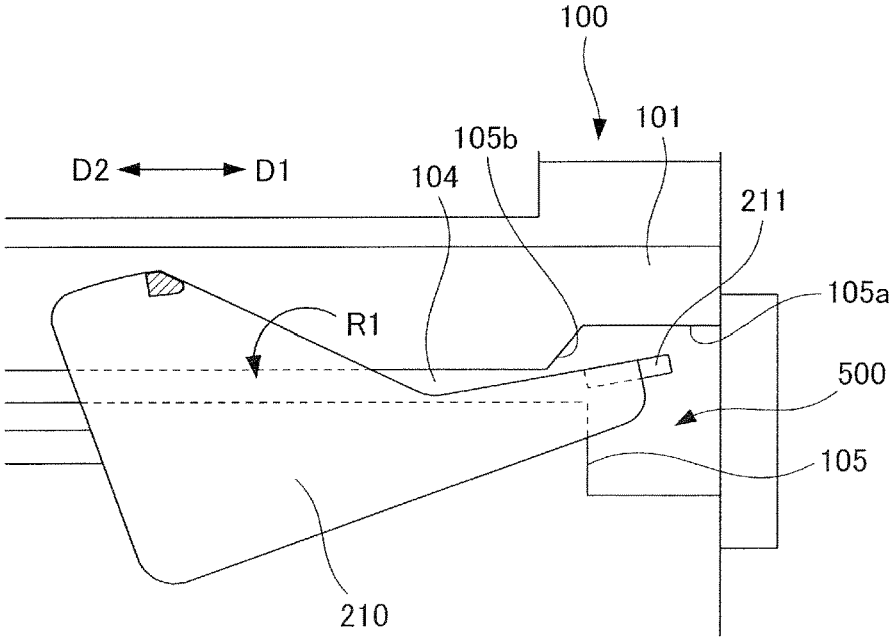
FIG. 17B is a side view illustrating a relationship between the protrusion of the swing plate and the lock portion of the apparatus body.

Provided at the front end portion of the swing plate 210 is the protrusion 211 protruding toward the inside of the cover member 200, i.e., toward the cartridge 100 covered by the cover member 200 (see FIG. 17B). The second side plate 203 is provided with a through hole 203*b* along the swing direction R of the swing plate 210 in an area corresponding to the front end portion in the insert direction D1 of the swing plate 210. Then, as illustrated in FIGS. 4B and 5A, the protrusion 211 formed at the front end portion of the swing plate 210 protrudes inside of the cover member 200 (see FIGS. 17A and 17B) through the through hole 203*b*. This arrangement makes it possible for the swing plate 210 to swing within a range in which the protrusion 211 is movable within the through hole 203*b*. As illustrated also in FIG. 5B, the swing plate 210 is provided with an engagement portion 212 projecting to a side opposite from the second side plate 203, i.e., to outside in the width direction W, at an upper end portion leaning the front end in the pull-out direction D2 thereof. That is, the cover member 200 shading the photosensitive drum 11 is removably attached to the cartridge 100 before being mounted to the apparatus body 1*a*, and the cartridge 100 is functionally compatible with the apparatus body 1*a*.

Attaching Cover Member To Drum Cartridge

As illustrated in FIGS. 6A through 7B, the cover member 200 is attached to the cartridge 100 before the cartridge 100 is mounted to the apparatus body 1*a*. The cartridge 100 is inserted from the opening 213 (see FIG. 4B) on the front end side in the insert direction D1 of the cover member 200. At this time, the rib 102 formed on one side surface 101L of the housing 101 of the cartridge 100 engages with a drum guide 202*a* formed on an inner surface of the first side plate 202 of the cover member 200 as illustrated in FIG. 7A. The guide 103 formed on the other side surface 101R of the housing 101 is also engaged with the holding rib 203*a* formed on the inner surface of the second side plate 203.

By engaging these guides serving as guide portions with the ribs, respectively, the cartridge 100 is guided within the cover member 200 along the pull-out direction D2. In the condition in which the cover member 200 is thus attached to the cartridge 100, a space in which the photosensitive drum 11 and others are disposed is covered by the top plate portion 201, the first side plate 202 and the second side plate 203 such that the photosensitive drum 11 and others are shaded so as not to be exposed outside.

Figure 7A:
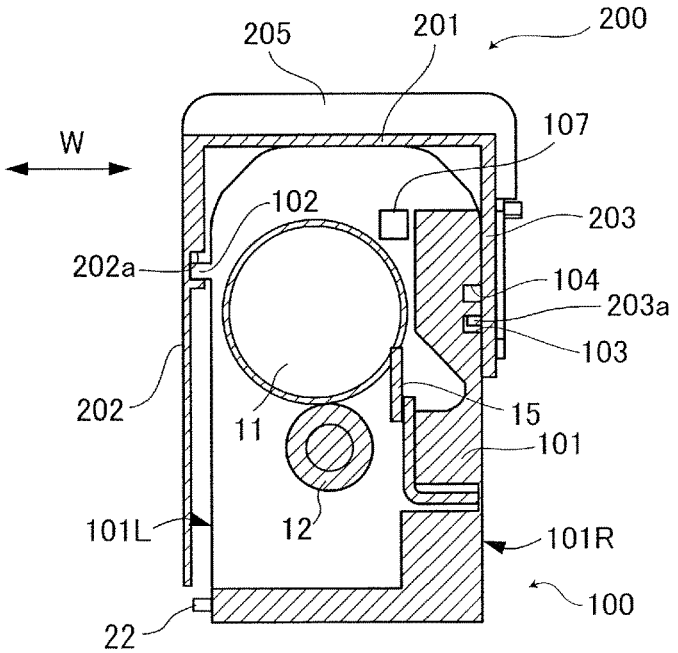
FIG. 7A is a section view illustrating the condition in which the cover member is attached to the drum cartridge of the present embodiment.
Figure 7B:
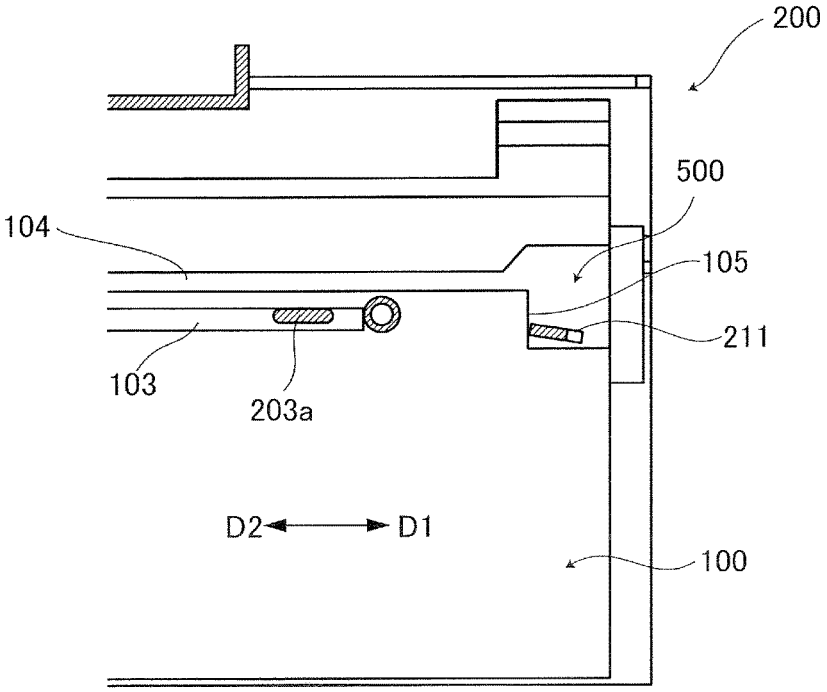
FIG. 7B is a longitudinal section view illustrating a condition in which the cover member is locked to the drum cartridge of the embodiment.

As illustrated in FIG. 7B, in the attachment condition of the cartridge 100 and the cover member 200, the protrusion 211 of the swing plate 210 of the cover member 200 engages with the lock portion 105 formed on the housing 101 of the cartridge 100. Therefore, the cartridge 100 and the cover member 200 are locked so as not to be separated as it is in the attachment condition, and the cartridge 100 is prevented so as not to be pulled out of the opening 213 on the front end side in the insert direction D1 of the cover member 200. That is, the cartridge 100 becomes relatively immovable in the insert direction D1 with respect to the cover member 200. It is noted that because the front end side in the pull-out direction D2 of the cover member 200 is covered by the rear side plate 206, the cartridge 100 will not be pulled out from the pull-out direction D2.

Replacing Drum Cartridge

Next, a replacing operation of the cartridge 100 of the present embodiment in the apparatus body 1*a* will be described. At first, an operation of pulling out the cartridge 100 attached to the apparatus body 1*a* will be described with reference to FIGS. 8A through 10.

Pulling Out Drum Cartridge

Figure 8A:
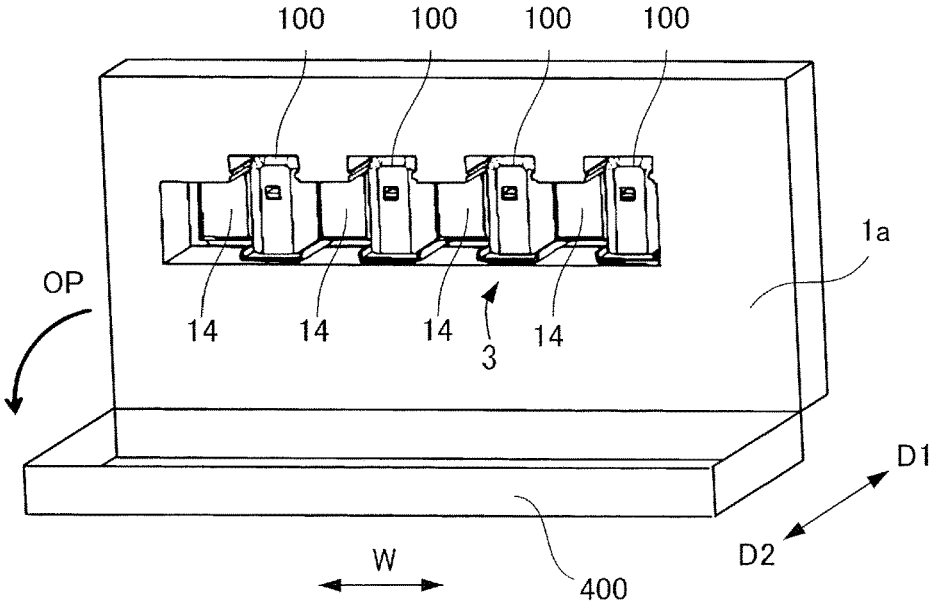
FIG. 8A is a perspective view illustrating a part of an apparatus body of the present embodiment in a condition in which a front cover is opened.
Figure 8B:
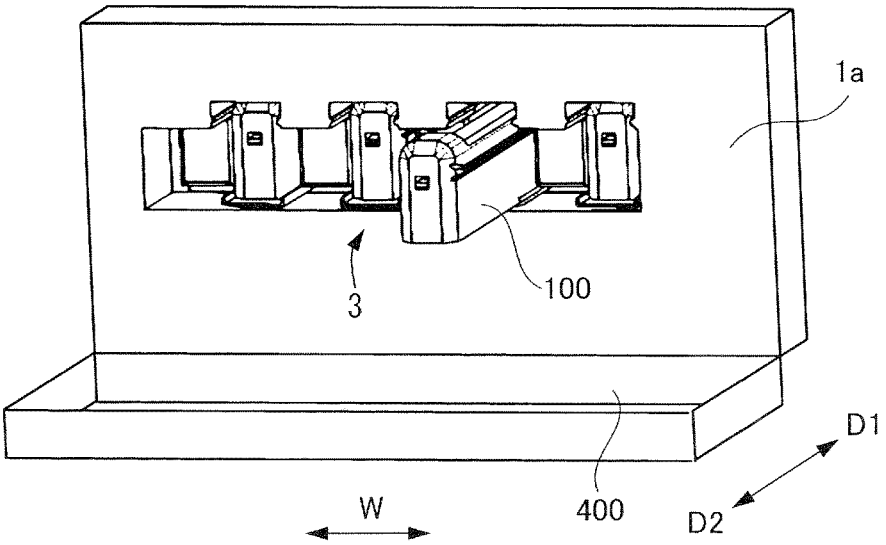
FIG. 8B is a perspective view illustrating a part of an apparatus body of the present embodiment in a condition in which the drum cartridge is taken out of the apparatus body.

FIGS. 8A and 8B are schematic diagrams simply excerpting and illustrating a configuration of a part of the image forming apparatus 1 of the present embodiment into which the cartridge 100 of each color is attached. The apparatus body 1*a* is provided with a front cover 400 openable on a front side, and it is possible to access to the cartridge 100 of each color by opening the front cover 400 in a direction OP as illustrated in FIG. 8A. The apparatus body la includes the plurality of cartridges 100 arrayed in order of yellow, magenta, cyan and black from the left side in FIG. 8A. The plurality of cartridges 100 has a common configuration from each other in the present embodiment. The cover member 200 configured to cover the cartridge 100 of each color also has a common configuration from each other. It is noted that the developing apparatus 14 of each color is disposed adjacent the cartridge 100 of each color, respectively in FIG. 8A.

While the replacement of the cartridge 100 of cyan (third one from the left side in FIG. 8A) will be described in the following description, the same applies also to the other color cartridges. Assume that a replacement sign of the cyan cartridge 100 is notified in a display, e.g., a control panel, not illustrated of the image forming apparatus 1 or in an external terminal connected to the image forming apparatus. In this case, an operator such as the user, a service man or the like opens the front cover 400 as illustrated in FIG. 8A. Next, the operator pulls the pertinent cartridge 100 out of the apparatus body 1*a* as illustrated in FIG. 8B.

Figure 9A:
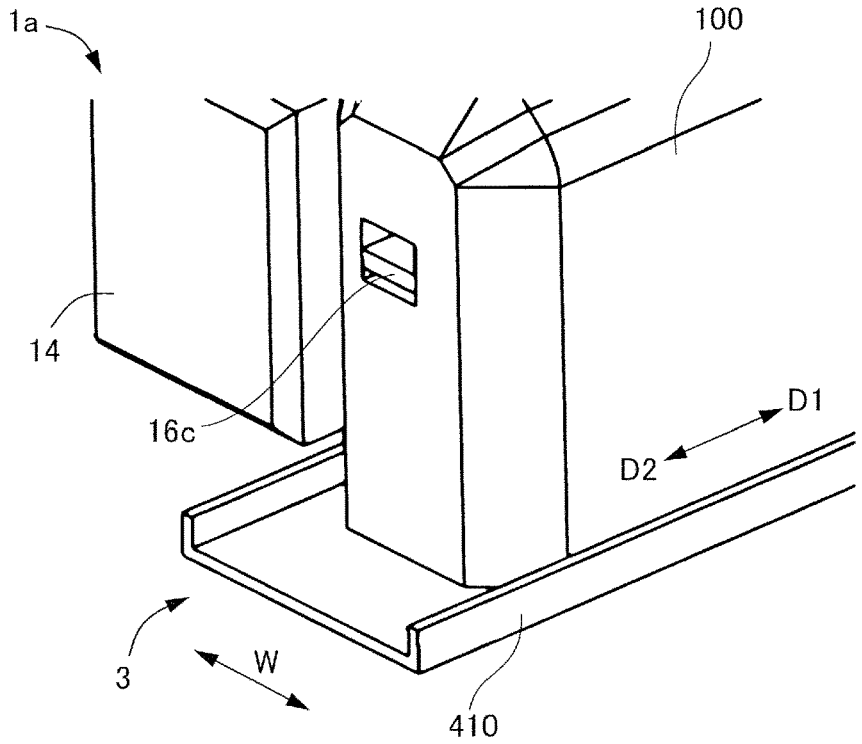
FIG. 9A is a perspective view illustrating a part of the apparatus body of the present embodiment in a condition in which the drum cartridge is installed on a guide rail.
Figure 9B:
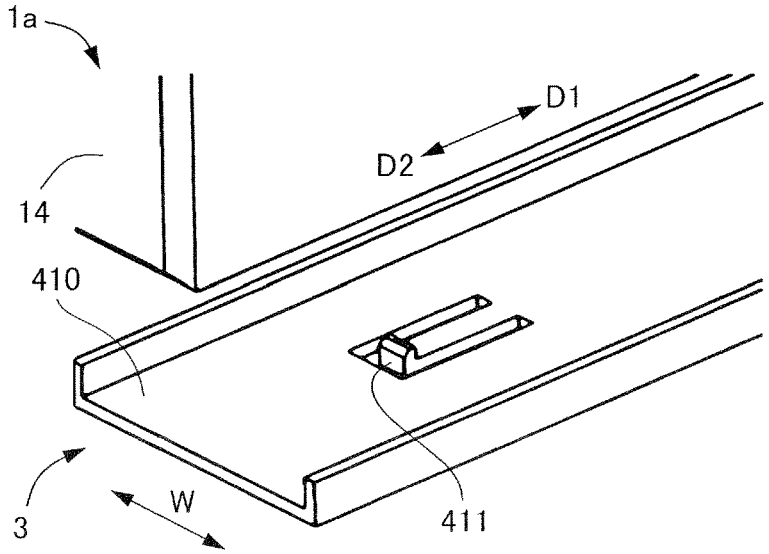
FIG. 9B is a perspective view illustrating a part of an apparatus body of the present embodiment in a condition in which the drum cartridge is taken out of the guide rail.
Figure 10:
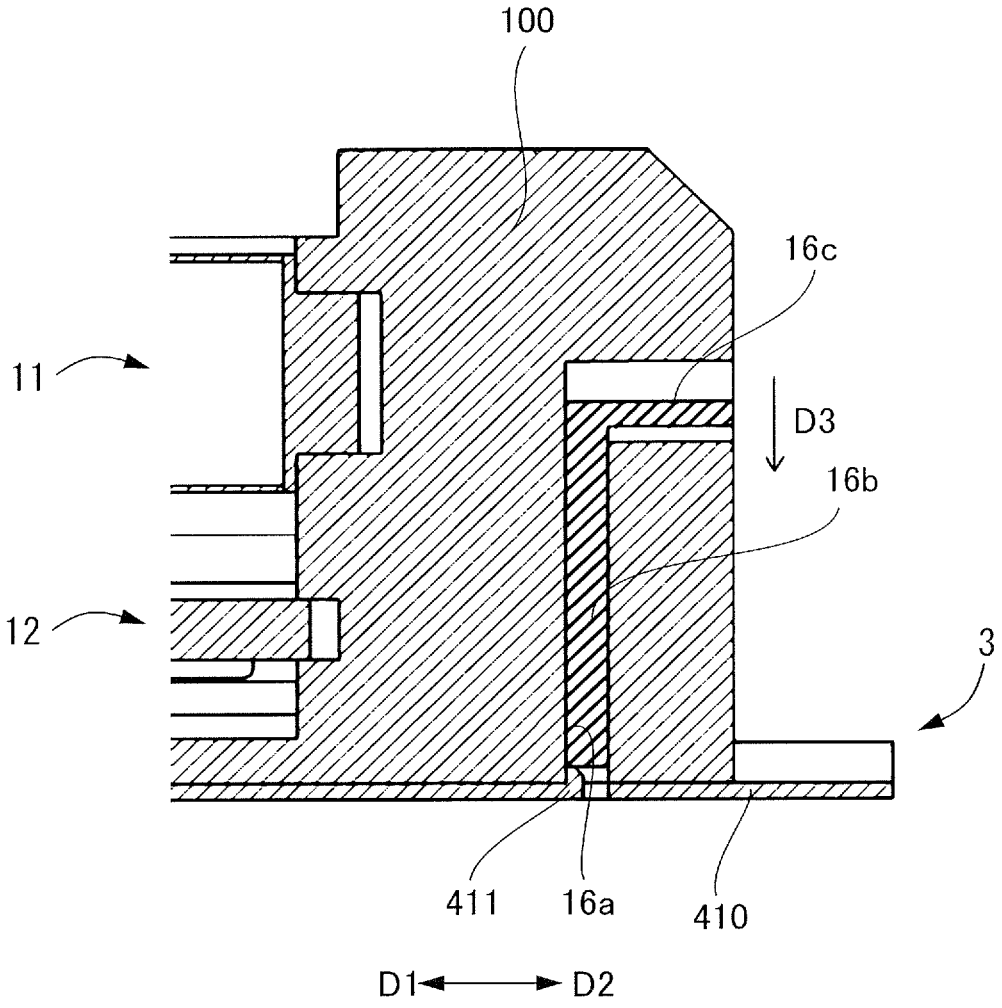
FIG. 10 is a section view illustrating a lock mechanism of the drum cartridge and the guide rail of the present embodiment.

As illustrated in FIGS. 9A through 10, the apparatus body 1*a* is provided with a guide rail, i.e., a first guide portion, 410 configured to guide the cartridge 100. The guide rail 410 is configured to match in shape with the cartridge 100 and to guide the cartridge 100 in a case where the cartridge 100 attached with the cover member 200 is inserted into the apparatus body 1*a* from an insertion slot portion 3 described later of the apparatus body 1*a*.

The guide rail 410 is provided with a locking hook 411 which is supported movably in the vertical direction by elastic deformation thereof and whose edge protrudes upward at a part of the guide rail 410 as illustrated in FIG. 9B. Meanwhile, as illustrated in FIG. 10, the housing 101 of the cartridge 100 (see FIG. 7A) is provided with an engage hole 16*a* at a bottom surface thereof In a condition in which the cartridge 100 is mounted on the guide rail 410 and is attached at a predetermined attachment position of the apparatus body 1*a*, the locking hook 411 engages with the engage hole 16*a* of the cartridge 100. Thereby, the cartridge 100 is locked so as not to be pulled out from the predetermined attachment position of the apparatus body 1*a*.

As illustrated in FIG. 10, an unlock member 16*b* is disposed within the engage hole 16*a*. The unlock member 16*b* is movable along the engage hole 16*a* formed in the vertical direction and includes a control lever 16*c* that is exposed to the front surface of the cartridge 100 and that can be controlled by the operator. If the operator pushes down the control lever 16*c* in a lower direction D3 in FIG. 10, a whole of the lock release member 16*b* is lowered. Then, the locking hook 411 is pressed down by a lower end portion of the unlock member 16*b*, and thus the engagement between the locking hook 411 and the engage hole 16*a* is released. Thereby, the cartridge 100 is unlocked from the guide rail 410, and the operator can pull the cartridge 100 out of the apparatus body 1*a* in the pull-out direction D2.

After pulling the cartridge 100 out of the apparatus body 1*a*, it is unnecessary to handle the cartridge 100 carefully as compared with a new cartridge to be inserted into the apparatus body 1*a*, because the cartridge 100 is no longer used. The service man or the like collects the cartridge 100 being pulled out. It is noted that the cover member 200 may be attached to the insertion slot portion 3 described later of the apparatus body 1*a* (see FIG. 8B) so as to guide the cartridge 100 to the inside of the cover member 200 in pulling out the cartridge 100. This arrangement makes it possible to prevent the operator from being soiled by toner or the like even if the toner or the like is adhering on the photosensitive drum 11 or the like.

Mounting Drum Cartridge

Figure 11A:
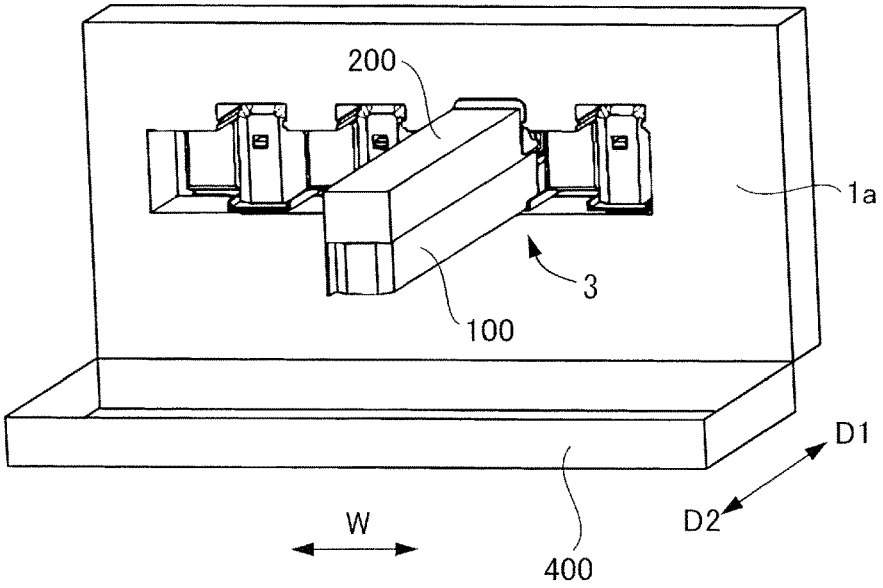
FIG. 11A is a perspective view illustrating a part of the apparatus body of the present embodiment in a condition in which the drum cartridge is set at an insert position through the cover member.
Figure 11B:
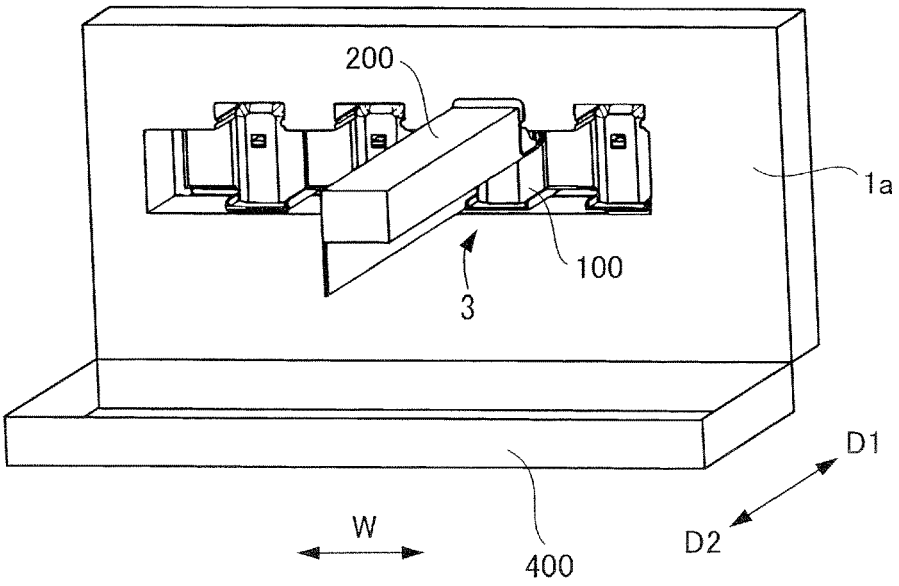
FIG. 11B is a perspective view illustrating a part of an apparatus body of the present embodiment in a condition in which the drum cartridge has been inserted into the apparatus body.

Next, an operation for mounting the cartridge 100 into the apparatus body 1*a* will be described with reference to FIGS. 11A through 12. At first, the operator inserts a new cartridge 100 covered by the cover member 200 into the insertion slot portion 3, i.e., a first insertion slot portion, of the apparatus body 1*a* as illustrated in FIG. 11A. Then, the operator inserts the cartridge 100 into the apparatus body 1*a* by relatively moving the cartridge 100 in the insert direction D1 with respect to the cover member 200 as illustrated in FIG. 11B.

Figure 12:
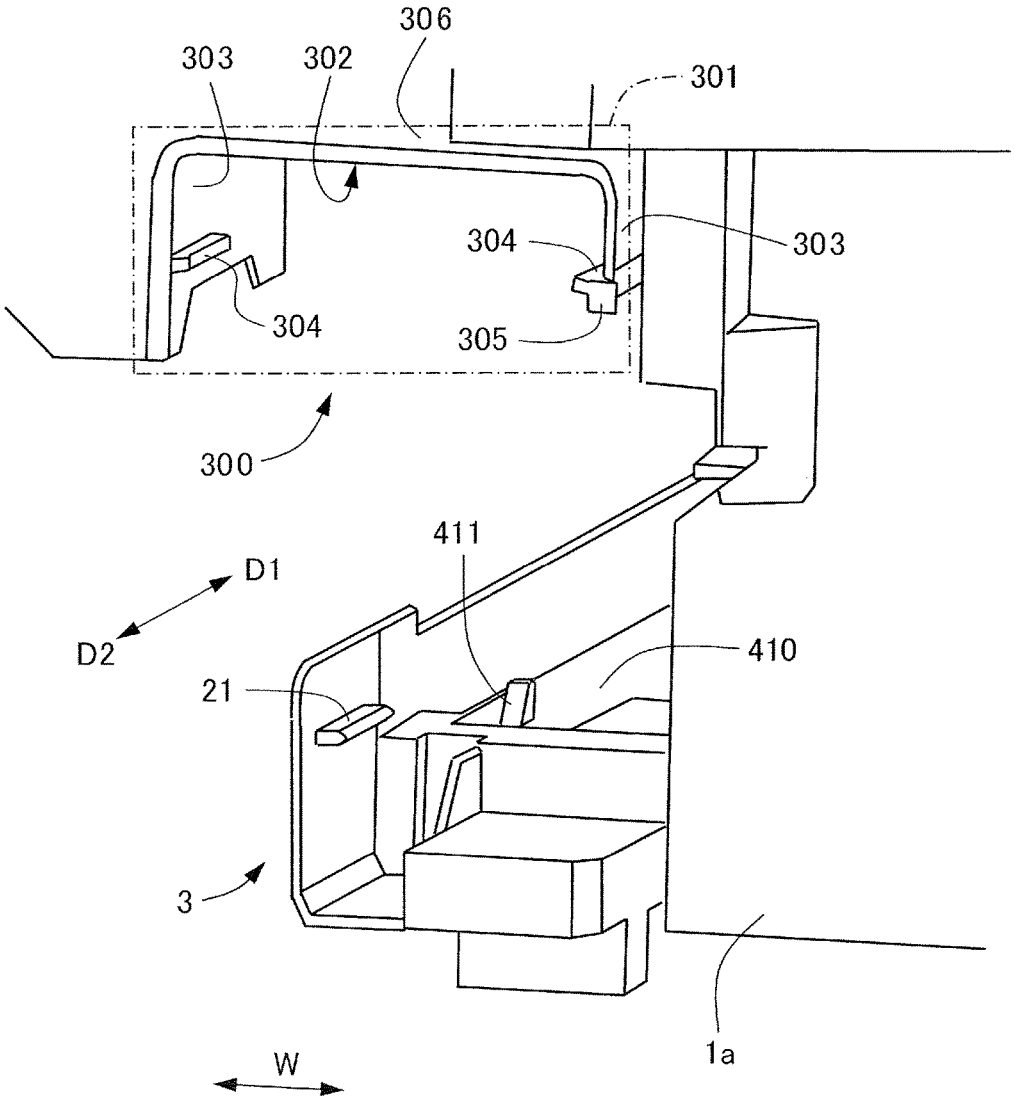
FIG. 12 is a perspective view illustrating a drum cartridge storage portion in the apparatus body of the present embodiment.

Here, as illustrated in FIG. 12, the apparatus body 1*a* includes a storage portion 300 formed toward the insert direction D1 from the insertion slot portion 3 so as to store the cartridge 100 inserted from the insertion slot portion 3. The storage portion 300 includes a supporting portion 301 formed engageably with the insert portion 204 (see FIG. 6A) provided at the front end portion in the insert direction D1 of the cover member 200. The supporting portion 301 supports the cover member 200 in the insert direction D1 of the cartridge 100 and a downstream end in the insert direction D1 of the cartridge 100 in a condition in which the cartridge 100 covered by the cover member 200 is inserted by a predetermined distance from the insertion slot portion 3 of the apparatus body 1*a*. If the operator releases his/her hands from the cover member 200 or the cartridge 100 in the condition as illustrated in FIG. 11A, the cover member 200 and the cartridge 100 drop by their own weights. Therefore, a support of the operator of holding a part of the cover member 200 or the cartridge 100 upstream in the insert direction D1 of the insert portion 204 is necessary in the condition illustrated in FIG. 11A.

The supporting portion 301 is formed so as to be concaved upward in the storage portion 300 and so as to have a predetermined length in the insert direction D1. The supporting portion 301 includes a supporting surface 302 provided at an upper surface, side walls 303 provided at both widthwise ends of the supporting surface 302, and guide ribs 304 formed on the side walls 303 along the insert direction D1. The supporting portion 301 is also provided with a projecting portion, i.e., an engaged portion, 305 formed so as to project downward at an end in the pull-out direction D2 of the guide rib 304 of one side (right side in FIG. 12) of the supporting portion 301 (left side in FIG. 16A). End faces on the pull-out direction D2 side of the supporting surface 302 and the side walls 303 are formed to be a contact surface 306 with which the contact portion 205 of the cover member 200 abuts (see FIG. 17A).

Meanwhile, the abutment surface 204*a* of the cover member 200 abuts with the supporting surface 302 in a condition in which the cover member 200 is inserted into the apparatus body 1*a*. The engagement ribs 204*b* of the cover member 200 are placed on the guide ribs 304, respectively, on the both widthwise ends of the abutment surface 204*a* and are engageable with the guide ribs 304.

The insert portion 204 of the cover member 200 is inserted into the supporting portion 301 of the apparatus body 1*a* in inserting the cartridge 100 covered by the cover member 200 toward the insert position from the insertion slot portion 3 of the apparatus body 1*a*In this condition, as the abutment surface 204*a* abuts with the supporting surface 302, the engage rib 204*b* is supported by the guide rib 304. That is, because the insert portion 204 is sandwiched vertically by the abutment surface 204*a* and the guide rib 304, the cover member 200 is restricted from moving in the vertical direction by the abutment surface 204*a* and the guide rib 304 in the condition as illustrated in FIG. 11A. The cover member 200 is also restricted from moving in the width direction W by the side walls 303 in the condition as illustrated in FIG. 11A. Then, the cover member 200 is guided toward the insert position by pushing the cover member 200 and the cartridge 100 in the insert direction D1 in this condition by the user.

Configuration Of Erroneous Insertion Blocking Portion

Figure 13:
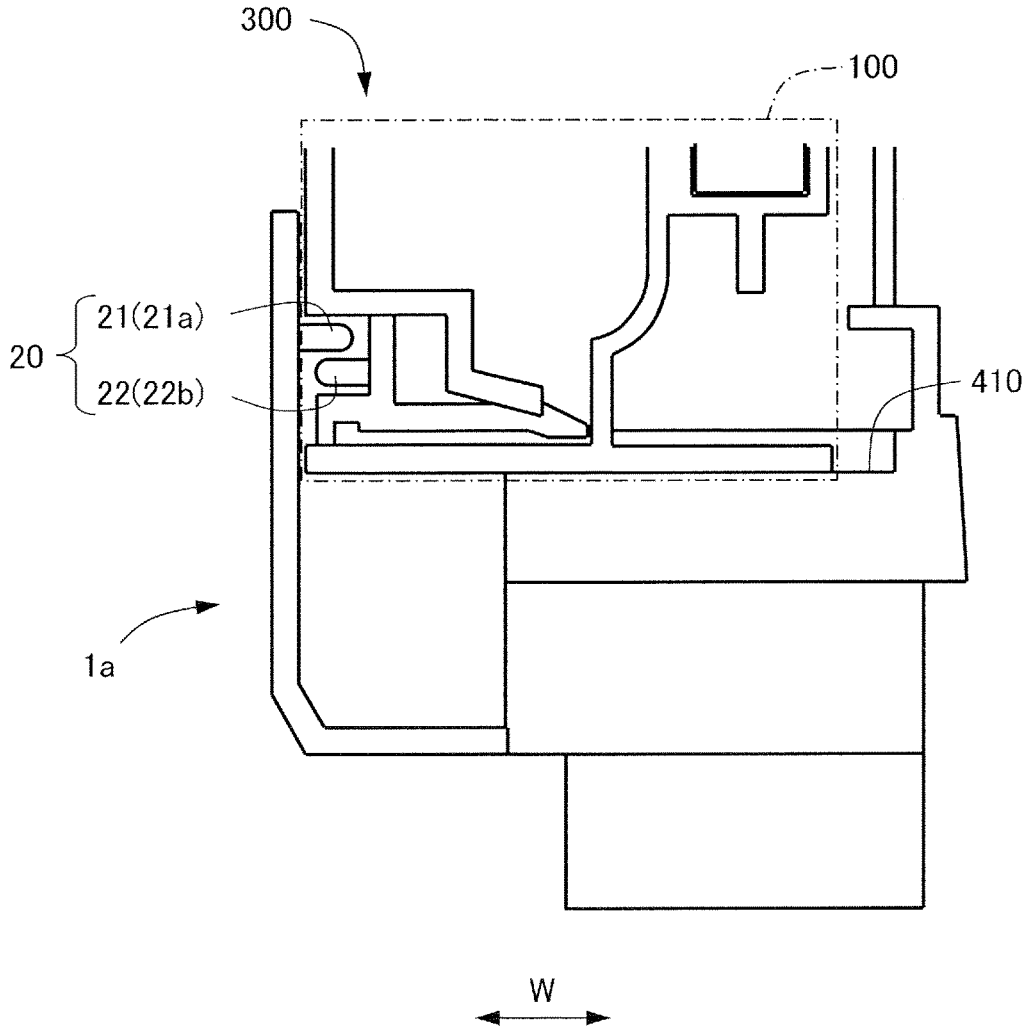
FIG. 13 is a section view illustrating an engage portion where the apparatus body of the present embodiment engages with the drum cartridge compatible with the apparatus body.
Figure 14A:
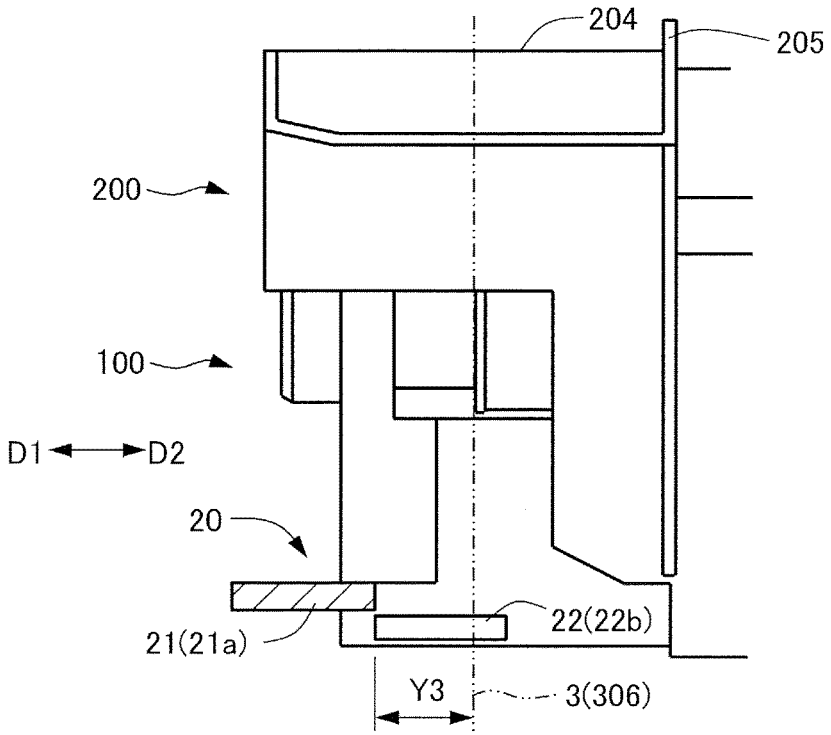
FIG. 14A is a side view illustrating the engage portion where the apparatus body of the embodiment engages with the drum cartridge compatible with the apparatus body in a condition in which the drum cartridge has been inserted by a third distance.
Figure 14B:
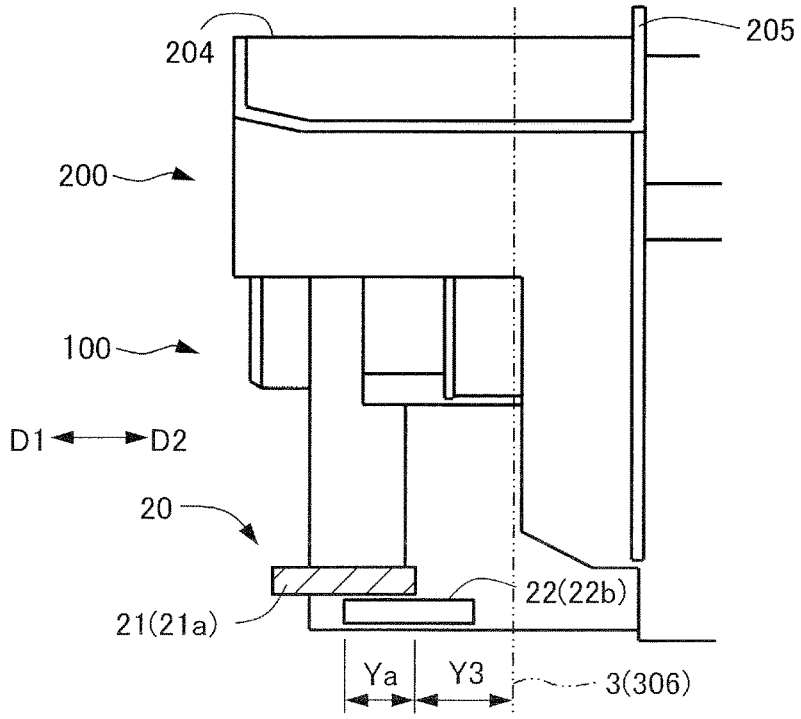
FIG. 14B is a side view illustrating a condition in which the drum cartridge has been inserted further from the third distance.
Figure 15A:
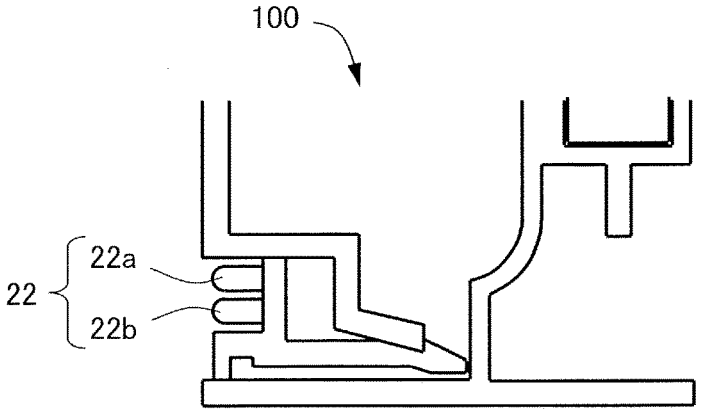
FIG. 15A is a section view illustrating the engage portion where the apparatus body of the embodiment engages with the drum cartridge compatible with the apparatus body in a condition in which the engage portion of the drum cartridge is processed.
Figure 15B:
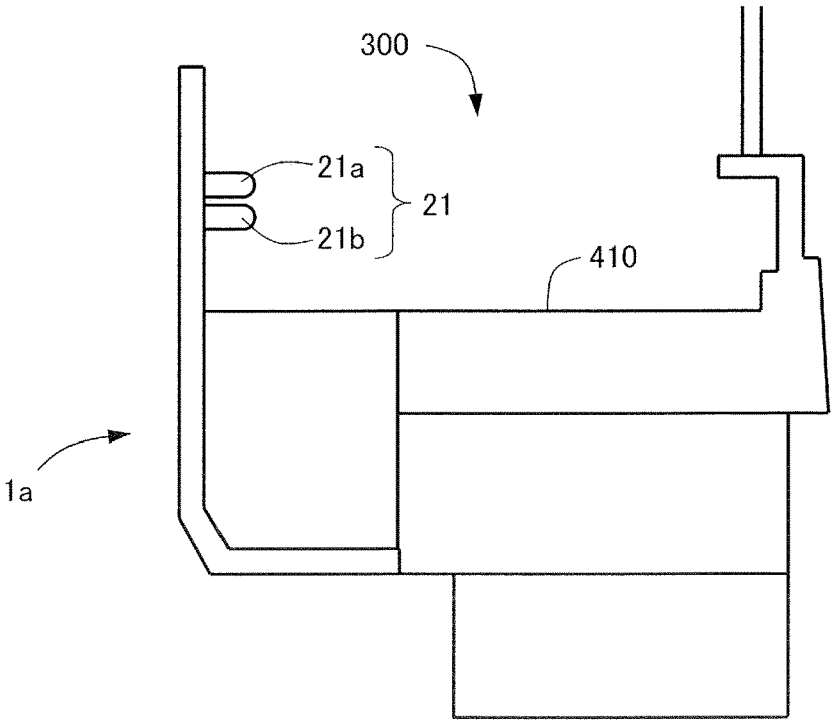
FIG. 15B is a section view illustrating the engage portion of the apparatus body.

A configuration of an erroneous insertion blocking portion, i.e., a first erroneous insertion blocking portion, 20 provided in the cartridge 100 and in the apparatus body 1*a* will be described with reference to FIGS. 12 through 15B. FIG. 13 is a section view illustrating an engage portion of the cartridge 100 and the apparatus body 1*a*. FIG. 14A is a section view illustrating the engage portion of the apparatus body 1*a* and the cartridge 100 when the cartridge 100 has been inserted by a third distance Y3. FIG. 14B is a section view illustrating the engage portion of the cartridge 100 and the apparatus body 1*a* when the cartridge 100 has been inserted by more than the third distance Y3 (Y3+Ya). FIG. 15A is a section view illustrating a condition before when a second project portion 22 provided in the cartridge 100 is processed, and FIG. 15B is a section view illustrating a condition before when a first project portion 21 provided in the apparatus body 1*a* is processed.

The erroneous insertion blocking portion 20 permits or restricts the insertion of the cartridge 100 in inserting the cartridge 100 into the apparatus body 1*a* through the insertion slot portion 3. The erroneous insertion blocking portion 20 is provided between the cartridge 100 and the apparatus body 1*a* and includes the first project portion, i.e., a first portion, 21 provided in the apparatus body 1*a* and a second project portion, i.e., a second portion, 22 (see FIG. 2A) provided in the cartridge 100. As illustrated in FIG. 12, the first project portion 21 is provided on a side of the cartridge 100 that has been inserted on the guide rail 410. In the present embodiment, the first project portion 21 is disposed inside of the storage portion 300 and at the front end portion in the pull-out direction D2 of the storage portion 300. As illustrated in FIG. 14A, the first project portion 21 is provided so as to have an end face on the pull-out direction D2 side at a position apart from the insertion slot portion 3, i.e., the contact surface 306, by the third distance Y3 in the insert direction D1 to have an adequate length in the insert direction D1 from that position. The third distance Y3 is shorter than a first distance Y1 described later. The second project portion 22 is provided outside of the cartridge 100 and at the front end portion in the insert direction D1. In a case where the cartridge 100 is guided by the guide rail 410, the second project portion 22 permits the guide rail 410 to guide the cartridge 100 without butting against the first project portion 21.

In a case where the cartridge 100 is inserted into the storage portion 300 of the apparatus body 1*a*, the following operation is carried out. It is noted that in FIGS. 14A and 14B, the insertion slot portion 3 is indicated by an imaginary line as the contact surface 306. As illustrated in FIG. 14A, in a case where the cartridge 100 is inserted by the third distance Y3 in the insert direction D1 from the insertion slot portion 3 of the apparatus body 1*a*, the end face on the insert direction D1 side of the second project portion 22 of the cartridge 100 arrives at a position of the end face on the pull-out direction D2 side of the first project portion 21 of the apparatus body 1*a*. Then, assume that the cartridge 100 is inserted further by a distance Ya in the insert direction D1 from the condition as illustrated in FIG. 14A. As illustrated in FIG. 14B, in a case where the cartridge 100 is inserted in the insert direction D1 from the insertion slot portion 3 by more than the third distance Y3 (Y3+Ya), the end face on the insert direction D1 side of the second project portion 22 does not interfere with the end face on the pull-out direction D2 side of the first project portion 21. Thereby, the second project portion 22 moves, without interfering with the first project portion 21, along the first project portion 21, and the cartridge 100 is inserted into the apparatus body 1*a*. It is noted that the third distance Y3 from the insertion slot portion 3 of the cartridge 100 is set to be shorter than the first distance Y1 described later.

Here, because the cartridge 100 is what is functionally compatible with the apparatus body 1*a*, the cartridge 100 can be inserted into the apparatus body 1*a* without being restricted by the erroneous insertion blocking portion 20. That is, in a case where the cartridge 100 is inserted by the third distance Y3 from the insertion slot portion 3, the erroneous insertion blocking portion 20 permits the cartridge 100 that is functionally compatible with the apparatus body 1*a* to be inserted further without causing butting of the first project portion 21 and the second project portion 22 from each other. At this time, as illustrated in FIG. 14A, the first and second project portions 21 and 22 are disposed such that the end face in the pull-out direction D2 of the first project portion 21 agrees with the end face in the insert direction D1 of the second project portion 22 in any view orthogonal to the insert direction D1. Still further, at this time, the first and second project portions 21 and 22 are disposed so as not to overlap with each other when viewed in the insert direction D1 as illustrated in FIG. 13.

According to the present embodiment, as illustrated in FIG. 15A, the second project portion 22 provided in the cartridge 100 includes two ribs of first and second ribs 22*a* and rib 22*b* before being processing. As illustrated also in FIG. 15B, the first project portion 21 provided in the apparatus body 1*a* includes two ribs of first and second ribs 21*a* and 21*b* before being processing. Then, those ribs are provided, when the cartridge 100 is guided by the guide rail 410 from the insertion slot portion 3, such that the first rib 21*a* butts against the first rib 22*a* on a same level and the second rib 21*b* butts against the second rib 22*b* on a same level.

In forming the apparatus body 1*a*, the second rib 21*b* is removed by scraping or the like among the two ribs 21*a* and 21*b* of the first project portion 21 for example. In forming the cartridge 100 functionally compatible with this apparatus body 1*a*, the first rib 22*a* facing the first rib 21*a* not removed in the first project portion 21 among the two ribs 22*a* and 22*b* of the second project portion 22 is removed by scraping or the like. Thereby, the first project portion 21 and the second project portion 22 do not butt against with each other, and the erroneous insertion blocking portion 20 permits the cartridge 100 functionally compatible with the apparatus body 1*a* to be inserted further after inserting by the third distance Y3. It is noted that a case where the cartridge is functionally incompatible with the apparatus body will be described later.

Next, a procedure for inserting the cartridge 100 described above into the apparatus body 1*a* will be described in detail with reference to FIGS. 16A through 20B.

First Step

Figure 16A:
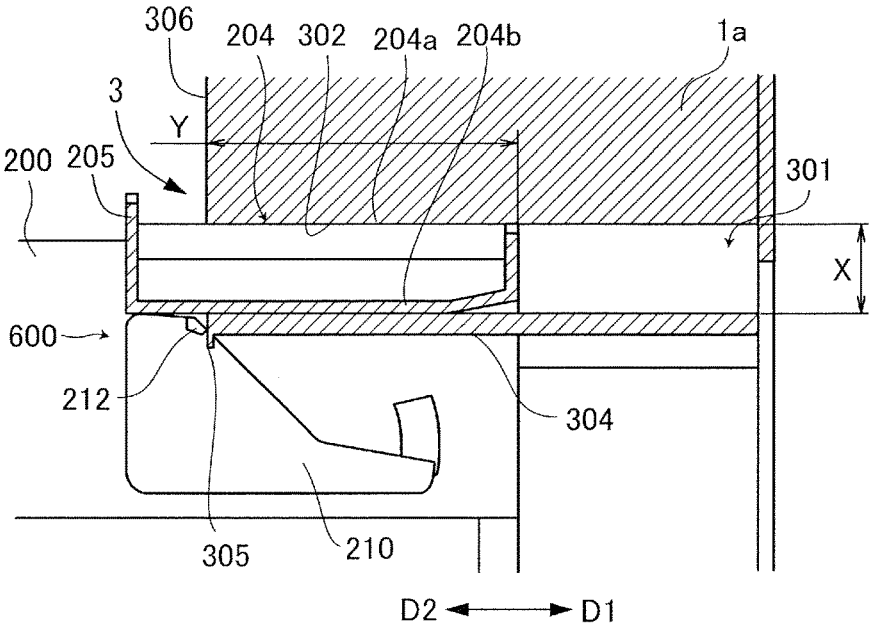
FIG. 16A is a longitudinal section view illustrating a relationship between an engage portion of a swing plate and a projecting portion of the apparatus body by which the drum cartridge of the embodiment is mounted to the apparatus body in a condition of a first step of mounting the drum cartridge to the apparatus body.

FIG. 16A illustrates a condition in which the cover member 200 and the cartridge 100 are inserted into the apparatus body 1*a* by a predetermined distance Y from the insertion slot portion 3 on the pull-out direction D2 side of the apparatus body 1*a*. At this time, the protrusion 211 of the swing plate 210 engages with the lock portion 105 of the cartridge 100, and the cartridge 100 is locked by the cover member 200 (see FIG. 7B). Then, the engagement portion 212 of the swing plate 210 provided in the cover member 200 butts against a front face of a projection 305 formed on a guide rib 304. It is noted that the front face of the projection 305 is a face of the projection 305 facing in the pull-out direction D2, i.e., a face in a front direction of the apparatus body 1*a*. A rear face of the projection 305 is a back side of the front face and is a face of the projection 305 in the insert direction D1, i.e., a face in a rear direction of the apparatus body 1*a*.

A gap X between the supporting surface 302 and an upper surface of the guide rib 304 is slightly larger than a gap between an abutment surface 204*a* of the insert portion 204 and a lower surface of the engage rib 204*b*, so that looseness between the insert portion 204 and the supporting portion 301 is small. Due to that, the cartridge 100 covered by the cover member 200 is supported by the apparatus body 1*a* in a condition in which the insert portion 204 is inserted into the supporting portion 301 by the predetermined distance Y. Thereby, even if the operator releases the cover member 200 and the cartridge 100, the cover member 200 and the cartridge 100 will not fall out of the apparatus body 1*a*.

Second Step

Figure 16B:
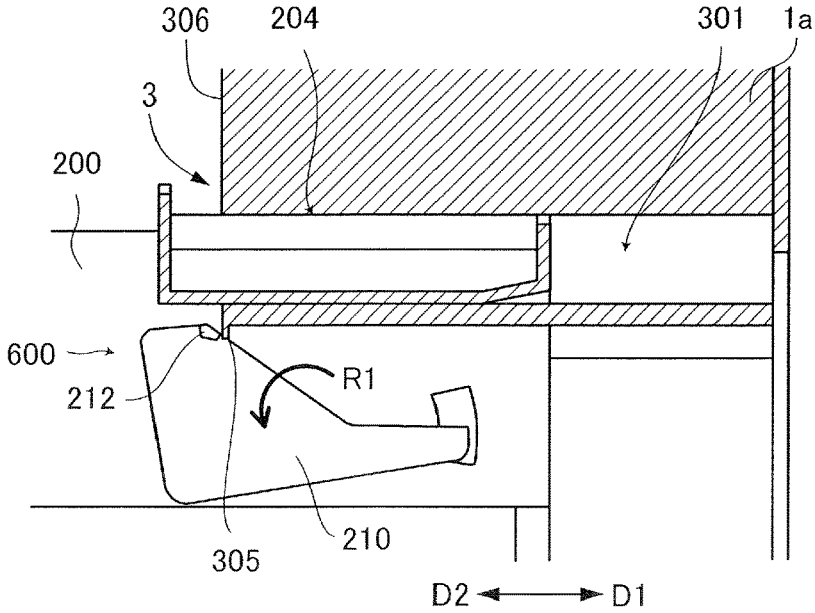
FIG. 16B is a longitudinal section view illustrating a relationship between an engage portion of a swing plate and a projecting portion of the apparatus body by which the drum cartridge of the embodiment is mounted to the apparatus body in a condition of a second step of mounting the drum cartridge to the apparatus body.

When the cover member 200 and the cartridge 100 are inserted further in the insert direction D1 from the condition as illustrated in FIG. 16A, the engagement portion 212 butts against the projection 305 and the swing plate 210 of the cover member 200 starts to turn in the unlock direction R1 as illustrated in FIG. 16B.

Third Step

When the cover member 200 and the cartridge 100 are inserted further in the insert direction D1, the swing plate 210 turns further in the unlock direction R1 and the engagement portion 212 passes under the projection 305 in the insert direction D1 as illustrated in FIG. 17A. At this time, the front end in the insert direction D1 of the cover member 200 and the cartridge 100 are inserted by the predetermined distance Y0 from the insertion slot portion 3. Then, the contact portion 205 of the cover member 200 butts against the contact surface 306 of the supporting portion 301 which is a part of the apparatus body 1*a*, so that the cover member 200 is not inserted any more. It is noted that the position of the cover member 200 and the cartridge 100 at this time is defined as a reference position. Still further, the protrusion 211 is disengaged from the lock portion 105 and the cover member 200 is unlocked from the cartridge 100 as illustrated in FIG. 17B. Due to that, the cartridge 100 becomes movable in the insert direction D1 with respect to the cover member 200.

According to the present embodiment, when the cartridge 100 covered by the cover member 200 is disposed at the reference position, i.e., at the position in FIG. 17A, the cover member 200 is unlocked from the cartridge 100. Thus, the image forming apparatus 1 comprises a unit locking mechanism 500 serving as a unit lock portion of locking and unlocking the cartridge 100 and the cover member 200. The unit locking mechanism 500 is composed of the engagement portion 212, the projection 305 serving as an engaged portion, the swing plate 210 serving as a moving unit, the protrusion 211 and the lock portion 105.

The engagement portion 212 is provided in the cover member 200 as described above. The projection 305 serving as the engaged portion is provided in the apparatus body 1*a* and is engageable with the engagement portion 212. The swing plate 210 is provided with the engagement portion 212 and is disposed movably (swingably) with respect to the cover member 200. The protrusion 211 is provided on the swing plate 210 and protrudes toward the cartridge 100 covered by the cover member 200. The lock portion 105 is engageable with the protrusion 211 and locks the cartridge 100 with the cover member 200 in the condition in which the lock portion 105 is engaged with the protrusion 211. When the cartridge 100 covered by the cover member 200 is disposed at the reference position, the engagement portion 212 engages with the projection 305, so that the swing plate 210 moves and the protrusion 211 is disengaged from the lock portion 105.

As illustrated in FIG. 17B, a release portion 105*a* dented upward more than a lock guide portion 104 is formed above the lock portion 105. Due to that, the protrusion 211 is movable upward more than the position of the lock guide portion 104 and corresponding to that, the swing plate 210 also becomes swingable in the unlock direction R1. As a result, the position of the engagement portion 212 can be lowered with respect to the projection 305, enabling to disengage the engagement portion 212 from the projection 305 more reliably.

Because the protrusion 211 is disengaged from the lock portion 105, the cartridge 100 unlocked from the cover member 200 becomes insertible into the apparatus body 1*a* while being guided by the cover member 200. As illustrated in FIG. 7A, the rib 102 of the cartridge 100 engages with the drum guide 202*a* of the cover member 200, and the guide 103 of the cartridge 100 engages with the holding rib 203*a* of the cover member 200. Due to that, the cartridge 100 can be inserted into the apparatus body 1*a* while being guided by the cover member 200 by the engagement of these members.

Fourth Step

Figure 18A:
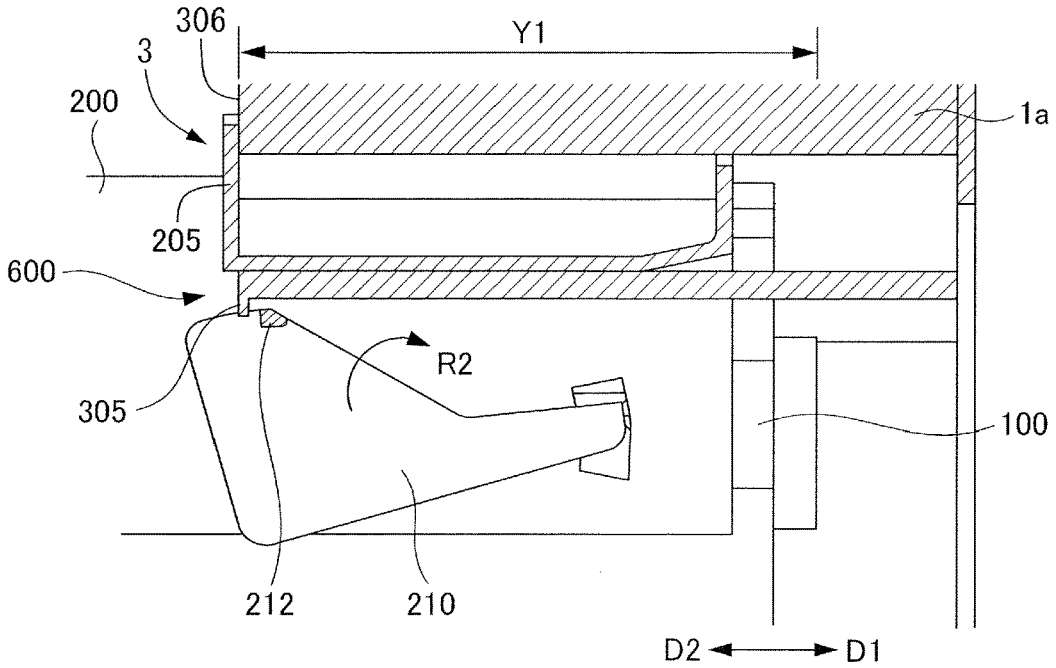
FIG. 18A is a section view illustrating the relationship between the engage portion of the swing plate and the projecting portion of the apparatus body in a condition of a fourth step of mounting the drum cartridge of the present embodiment to the apparatus body.
Figure 18B:
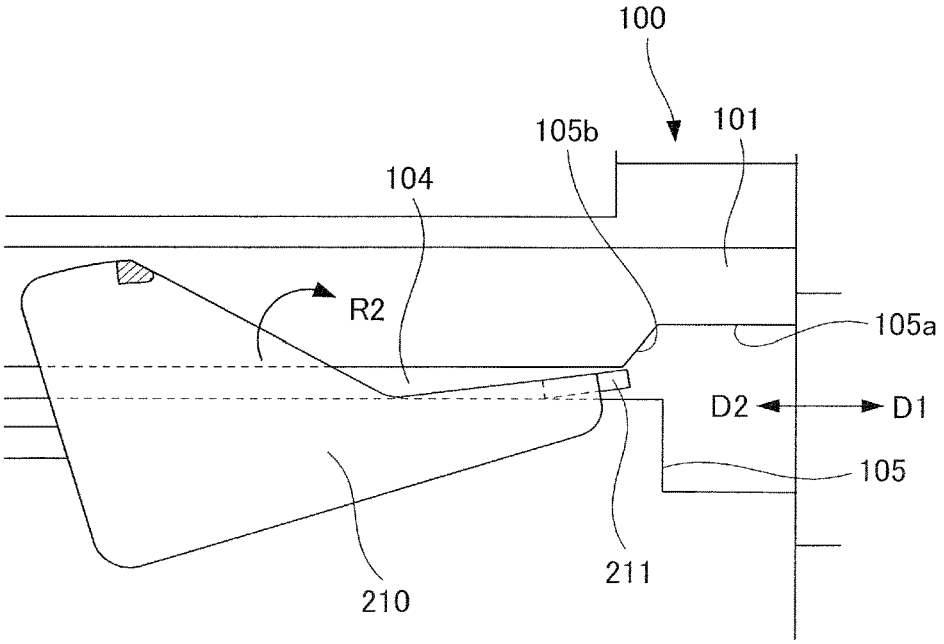
FIG. 18B is a side view illustrating a relationship between the protrusion of the swing plate and a lock guide portion of the apparatus body.

Only the cartridge 100 is inserted toward the rear side of the apparatus body 1*a* by the first distance Y1 from the insertion slot portion 3 from the reference position indicated in FIG. 17A. At this time, the protrusion 211 located above the lock guide portion 104 due to the release portion 105*a* is engaged with the lock guide portion 104 by being guided to an inclined portion 105*b* formed between the release portion 105*a* and the lock guide portion 104 as illustrated in FIG. 18B. Thereby, the swing plate 210 swings in the lock direction R2 and the engagement portion 212 that has previously passed under the projection 305 rises to a level engageable with the rear face of the projection 305 as illustrated in FIG. 18A. Due to that, even if the cover member 200 is tried to be moved in the pull-out direction D2, the move is restricted by the engagement portion 212 butting against the rear face of the projection 305. Still further, even if the cover member 200 is tried to be moved in the insert direction D1, the cover member 200 is not inserted further because the contact portion 205 butts against the contact surface 306 of the apparatus body 1*a*. Due to that, the cover member 200 is locked to the apparatus body 1*a* in the insert direction D1 and the pull-out direction D2 and cannot be taken out of the apparatus body 1*a*.

According to the present embodiment, the image forming apparatus 1 comprises a body locking mechanism 600 serving as a body locking unit configured to lock and unlock the apparatus body 1*a* and the cover member 200. The body locking mechanism 600 is composed of the engagement portion 212 and the projection 305 serving as the engaged portion. Then, in a case where the cartridge 100 attached with the cover member 200 is inserted by the first distance Y1 from the insertion slot portion 3 by being guided by the guide rail 410, the body locking mechanism 600 locks the apparatus body 1*a* with the cover member 200. Meanwhile, in a case where the cartridge 100 is inserted by the second distance Y2 from the insertion slot portion 3 by being guided by the guide rail 410, the body locking mechanism 600 unlocks the cover member 200 from the apparatus body 1*a*.

The body locking mechanism 600 is composed of the swing plate 210 serving as the moving unit, the protrusion 211, the lock guide portion 104 and the unlock guide portion 106. The lock guide portion 104 is formed approximately in parallel with the insert direction D1 in a range in which the cartridge 100 moves with respect to the cover member 200 to a position not including the position of the second distance Y2 between the first distance Y1 and the second distance Y2. Then, when the cartridge 100 moves within this range, the lock guide portion 104 engages with and guides the protrusion 211 such that the swing plate 210 is kept at the engage position where the engagement portion 212 is engaged with the projection 305. Meanwhile, in a case where the cartridge 100 moves to the position of the second distance Y2, the unlock guide portion 106 engages with and guides the protrusion 211 such that the swing plate 210 is moved to the disengage position where the engagement portion 212 is disengaged from the projection 305. This point will be described later.

Thus, according to the present embodiment, the body locking mechanism 600 is common with the unit locking mechanism 500 in terms of the configurations of the engagement portion 212, the projection 305, the swing plate 210 and the protrusion 211. The lock guide portion 104 and the unlock guide portion 106 are grooves defined continuously from the lock portion 105. Therefore, the body locking mechanism 600 and the unit locking mechanism 500 have the mechanically common configuration.

Here, it is unable to pull the cover member 200 out of the apparatus body 1*a*, even if the cover member 200 is tried to be pulled out from the apparatus body 1*a* in the condition in which the cover member 200 is locked to the apparatus body 1*a*. That is, because the swing plate 210 is restricted from swinging by the protrusion 211 engaged with the lock guide portion 104 as illustrated in FIG. 18B, the condition in which the engagement portion 212 is engaged with the rear face of the projection 305 as illustrated in FIG. 18A is maintained. Therefore, it is unable to pull the cover member 200 out of the apparatus body 1*a*.

Meanwhile, in a case where the cartridge 100 that has been inserted by more than the first distance Y1 from the insertion slot portion 3 is returned to the reference position, the cover member 200 is unlocked from the apparatus body 1*a*. That is, in a case where the cartridge 100 is returned to the reference position, the protrusion 211 moves to a region of the lock portion 105 on the front end side in the insert direction D1 more than the lock guide portion 104 as illustrated in FIG. 17B. As a result, the swing plate 210 becomes swingable in the unlock direction R1 and the engagement portion 212 is disengaged from the projection 305 as illustrated in FIG. 17A, so that the cover member 200 is unlocked from the apparatus body 1*a*. Accordingly, it is possible to take the cover member 200 and the cartridge 100 out of the apparatus body 1*a* by returning the cartridge 100 to the reference position.

It is noted that while it has been described that the body locking mechanism 600 for locking the apparatus body 1*a* with the cover member 200 is unlocked in the case where the cartridge 100 which has been inserted by more than the first distance Y1 from the insertion slot portion 3 is returned to the reference position, the present disclosure is not limited to such configuration. For instance, it may be configured such that the cover member 200 is not unlocked from the apparatus body 1*a* even if the cartridge 100 is returned to the reference position.

It is noted that the first distance Y1 from the insertion slot portion 3 may be a distance by which the cartridge 100 has substantially moved in the insert direction D1 with respect to the cover member 200 more than the reference position indicated in FIG. 17A. That is, the operator may lock the cover member 200 with the apparatus body 1*a* by pushing only the cartridge 100 from the condition in which the cartridge 100 and the cover member 200 are set at the reference position. However, there is a case where only the cartridge 100 moves slightly in the insert direction D1 by momentum and others when the operator sets the cartridge 100 and the cover member 200 at the reference position. It is not preferable to lock the cover member 200 also in such a case. Therefore, the first distance Y1 is set as a length of degree of not locking the cover member 200 and the apparatus body 1*a* in a case where the cartridge 100 slightly moves as described above. Accordingly, the first distance Y1 is set to be greater than the looseness in the insert direction D1 between the cartridge 100 and the cover member 200 for example.

Fifth Step

Figure 19A:
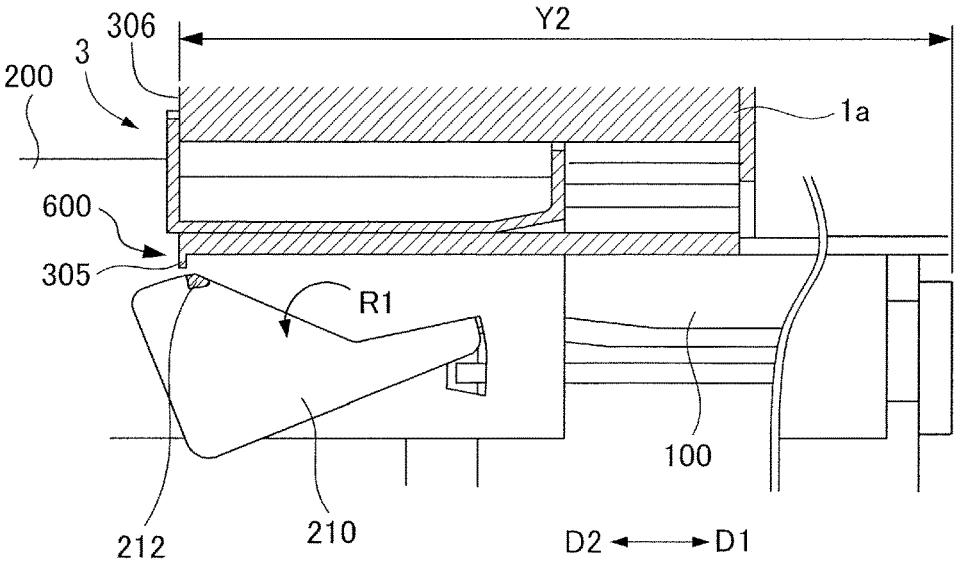
FIG. 19A is a section view illustrating the relationship between the engage portion of the swing plate and the projecting portion of the apparatus body in a condition of a fifth step of mounting the drum cartridge of the present embodiment to the apparatus body.
Figure 19B:
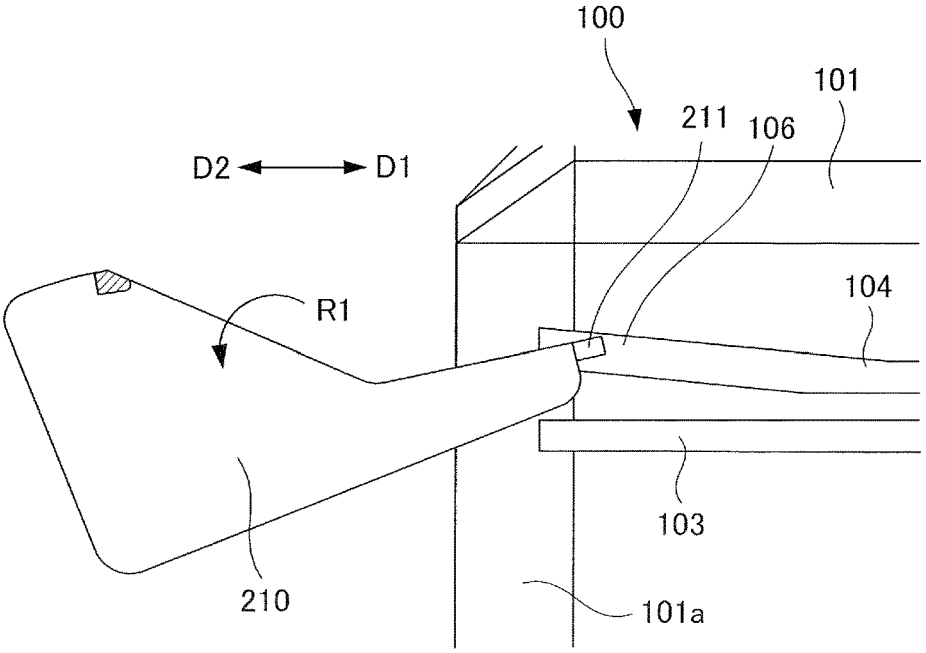
FIG. 19B is a side view illustrating a relationship between the protrusion of the swing plate and an unlock guide portion of the apparatus body.

Only the cartridge 100 is inserted toward the rear side of the apparatus body 1*a* further from the condition as illustrated in FIG. 18A. When the cartridge 100 is inserted by the second distance Y2 which is longer than the first distance Y1 from the insertion slot portion 3, the protrusion 211 of the swing plate 210 relatively moves with respect to the cartridge 100 and is guided to the unlock guide portion 106 as illustrated in FIG. 19B. Because the unlock guide portion 106 inclines upward more than the lock guide portion 104 in the pull-out direction D2, the swing plate 210 turns in the unlock direction R1 as the protrusion 211 is engaged with and guided by the unlock guide portion 106. As illustrated in FIG. 19A, the engagement portion 212 of the swing plate 210 moves to a position under the projection 305, i.e., a disengage position, where the engagement portion 212 does not engage with the projection 305, so that the cover member 200 is unlocked from the apparatus body 1*a* and it becomes possible to take the cover member 200 out of the apparatus body 1*a*.

The guide 103 and the unlock guide portion 106 formed on the other side surface 101R of the housing 101 of the cartridge 100 are opened to the pull-out direction D2 side of the other side surface 101R. Here, as illustrated in FIG. 2A, the both side surfaces 101L and 101R of the housing 101 are continuous respectively to an end face of the housing 101 on the pull-out direction D2 side by inclined faces 101*a*. The pair of inclined faces 101*a* inclines such a distance between the inclined faces 101*a* becomes narrow in the pull-out direction D2. Accordingly, the guide 103 and the unlock guide portion 106 are provided so as to intrude into the inclined face 101*a* by their depths.

This arrangement makes it possible for the holding rib 203*a* and the protrusion 211 respectively engaging with the guide 103 and the unlock guide portion 106 to be pulled out of the guide 103 and the unlock guide portion 106 on the pull-out direction D2 side. Still further, as illustrated in FIGS. 4B and 5A, a drum guide 202*a* formed on the cover member 200 is also opened on the pull-out direction D2 side of the cover member 200. This arrangement makes it possible for the rib 102 of the cartridge 100 engaging with the drum guide 202*a* to be pulled out on the pull-out direction D2 side from the drum guide 202*a*. Thereby, the cover member 200 can be also removed out of the cartridge 100 in taking the cover member 200 out of the apparatus body 1*a*. That is, it is possible to take the cover member 200 out of the apparatus body 1*a* and the cartridge 100 just by inserting the cartridge 100 by the second distance Y2 from the insertion slot portion 3.

It is noted that the distances from the insertion slot portion 3 are set in order of the third distance Y3, the first distance Y1 and the second distance Y2. Preferably, the second distance Y2 is a distance until when the cartridge 100 is inserted into the predetermined mount position of the apparatus body, that is, a distance to the mount position to which the cartridge 100 is inserted. At the predetermined mount position, the locking hook 411 of the apparatus body 1*a* is engaged with the engage hole 16*a* of the cartridge 100, and the cartridge 100 is locked to the apparatus body 1*a* as illustrated in FIG. 10. Therefore, it is possible to prevent the cartridge 100 from being pulled out carelessly in taking the cover member 200 out of the apparatus body 1*a*.

However, the second distance Y2 is not limited to be the distance until when the cartridge 100 is inserted into the mount position. For instance, the second distance Y2 may be a distance to a position where a center of gravity of the cartridge 100 enters the apparatus body 1*a*. The position where the center of gravity of the cartridge 100 enters the apparatus body 1*a* is a position where the center of gravity of the cartridge 100 rides on the guide rail 410 of the apparatus body 1*a* for example. If the center of gravity of the cartridge 100 is located on the guide rail 410 of the apparatus body 1*a*, it is possible to prevent the cartridge 100 from falling out of the apparatus body 1*a* even when the cover member 200 is taken out. Still further, in the case where the cartridge 100 includes the photosensitive drum 11 like the present embodiment, the second distance Y2 may be a position where the photosensitive drum 11 is stored in the apparatus body 1*a*. That is, as long as the photosensitive drum 11 is stored within the apparatus body 1*a*, the photosensitive drum 11 is hardly exposed outside even if the cover member 200 is taken out and the photosensitive drum 11 is hardly damaged or is exposed to light in inserting the cartridge 100.

Figure 20A:
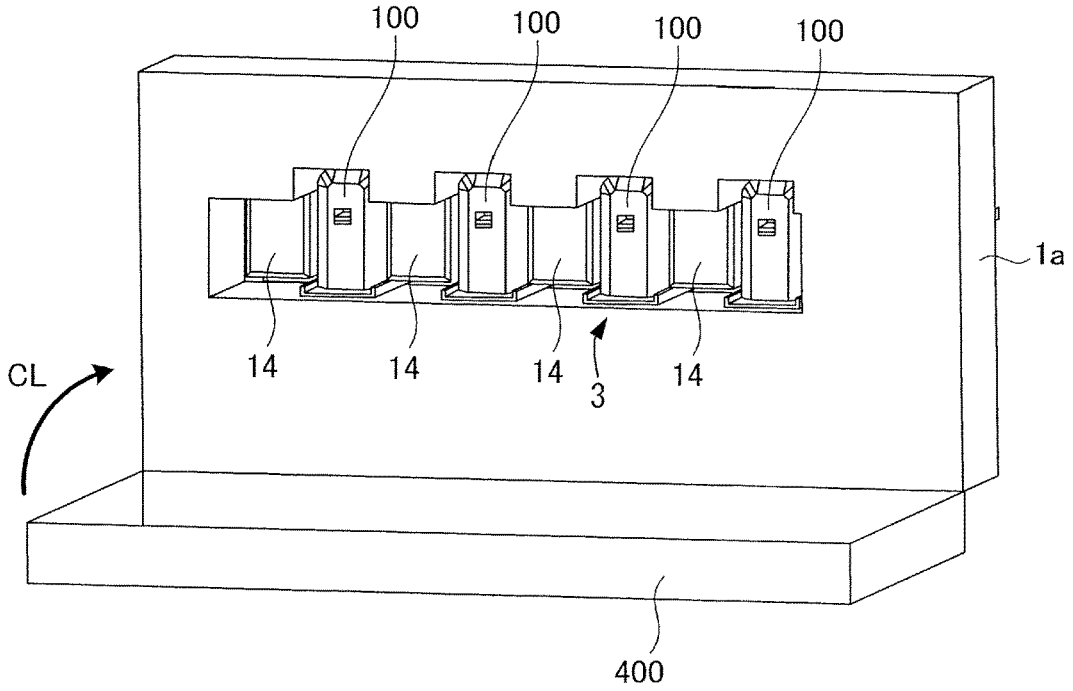
FIG. 20A is a perspective view illustrating a part of the apparatus body of the present embodiment in a condition in which the drum cartridge is mounted to the apparatus body.
Figure 20B:
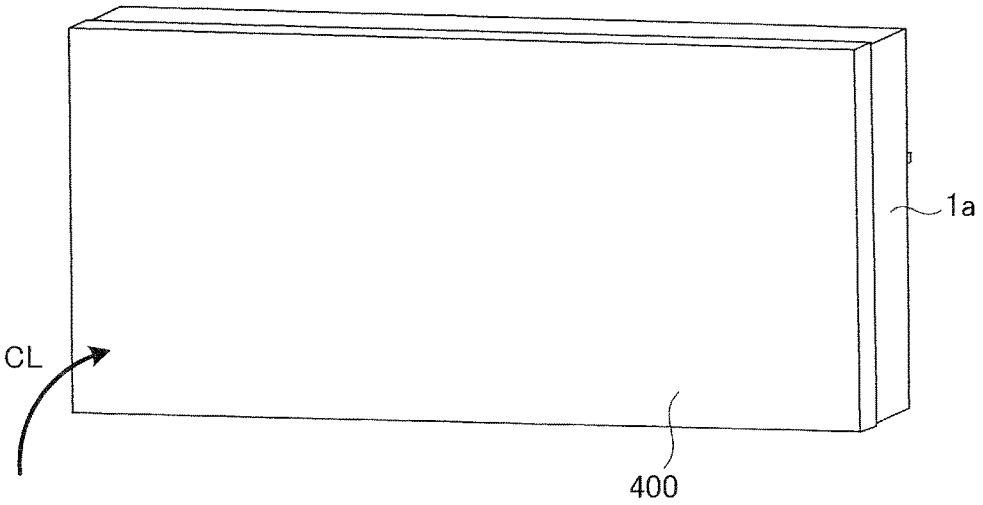
FIG. 20B is a perspective view illustrating a condition in which the front cover is closed.

On and after inserting the cartridge 100 by the second distance Y2 from the insertion slot portion 3, the cover member 200 is taken out of the apparatus body 1*a* and the cartridge 100. According to the present embodiment, the cover member 200 is taken out after inserting the cartridge 100 to the predetermined mount position. As a result, the cartridge 100 is mounted to the predetermined mount position as illustrated in FIG. 20A, and then the replacing works of the cartridge 100 is completed by closing the front cover 400 in the direction CL as illustrated in FIG. 20B.

Inserting Drum Cartridge Having Different Function Into Apparatus Body

Next, the erroneous insertion blocking portion 20 of the apparatus body 1*a* of the present embodiment will be described with reference to FIGS. 21 and 22. Normally, it is necessary to differentiate the photosensitive layer of the photosensitive drum, toner and others depending on image forming speed. It is also necessary to design an angle of contact of the cleaning blade with the surface of the photosensitive drum and durability of the coupling for rotating the photosensitive drum corresponding to the image forming speed. To that end, for image forming apparatuses with different image forming speed, it is necessary to mount a cartridge compatible with each apparatus. Still further, as another exemplary case, it is conceivable a case where the apparatus body 1*a* is marketed in either specification of a color image forming apparatus and a monochrome image forming apparatus. In a case where the apparatus body 1*a* is used as the color image forming apparatus, it is necessary to mount a black cartridge including the light guide 107 in the apparatus so that a destaticization control is reliably made. In a case where the apparatus body 1*a* is used as the monochrome image forming apparatus, a black cartridge not including the light guide 107 should be mounted for the user using an apparatus thereof by considering an aspect of cost. Then, for common usage of the case of the cartridges, cartridges functionally different, even though having identical cover members in shape, may exist from the aspect described above. For instance, even if cartridges can be inserted into an apparatus body by being guided by a guide rail, there may be a case where a photosensitive drum of the cartridge is not compatible with a specification of the apparatus body and does not operate adequately. Then, a case where the same cover member is commonly used for a plurality of cartridges having different functions and the cartridges can be mounted to a plurality of apparatus bodies having different functions will be described.

Figure 21:
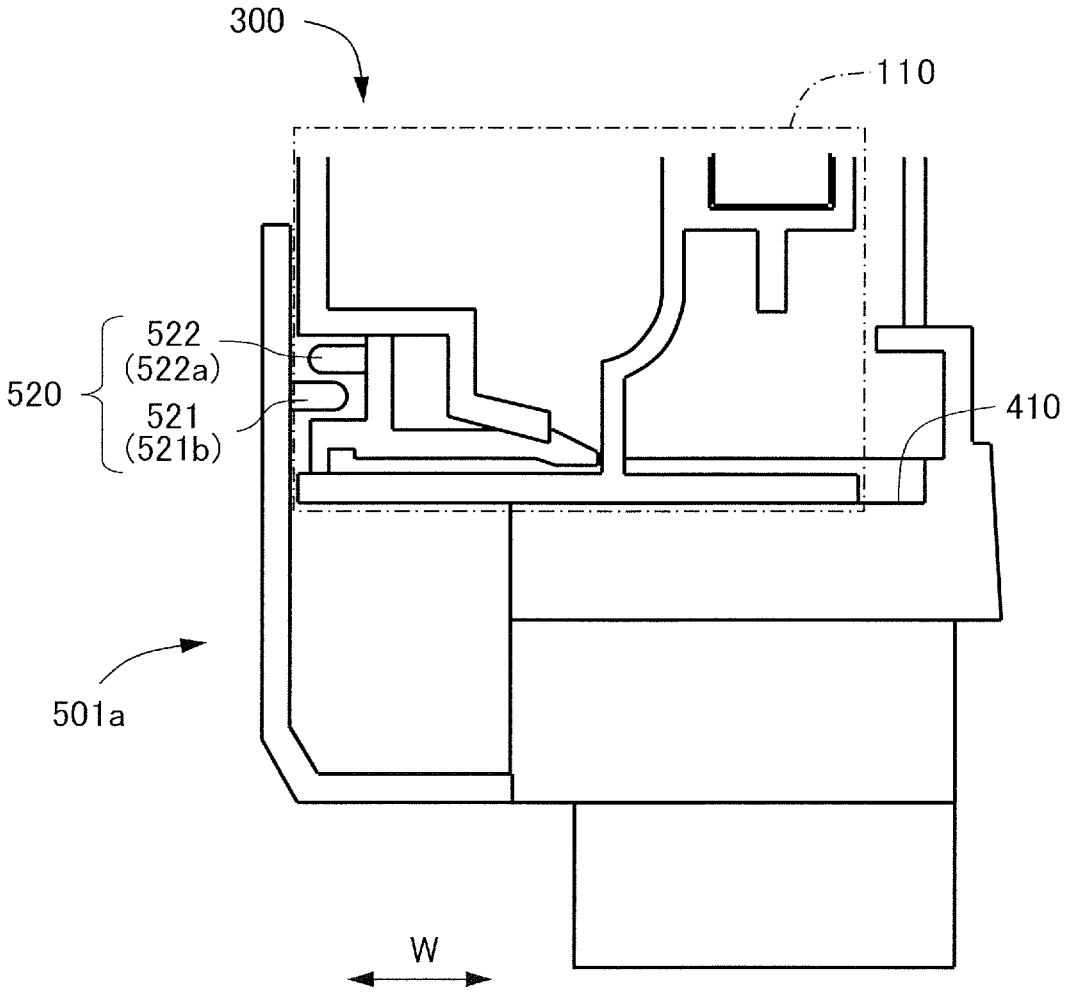
FIG. 21 is a section view illustrating an engage portion where a drum cartridge incompatible with an apparatus body is engaged with the apparatus body.
Figure 22:
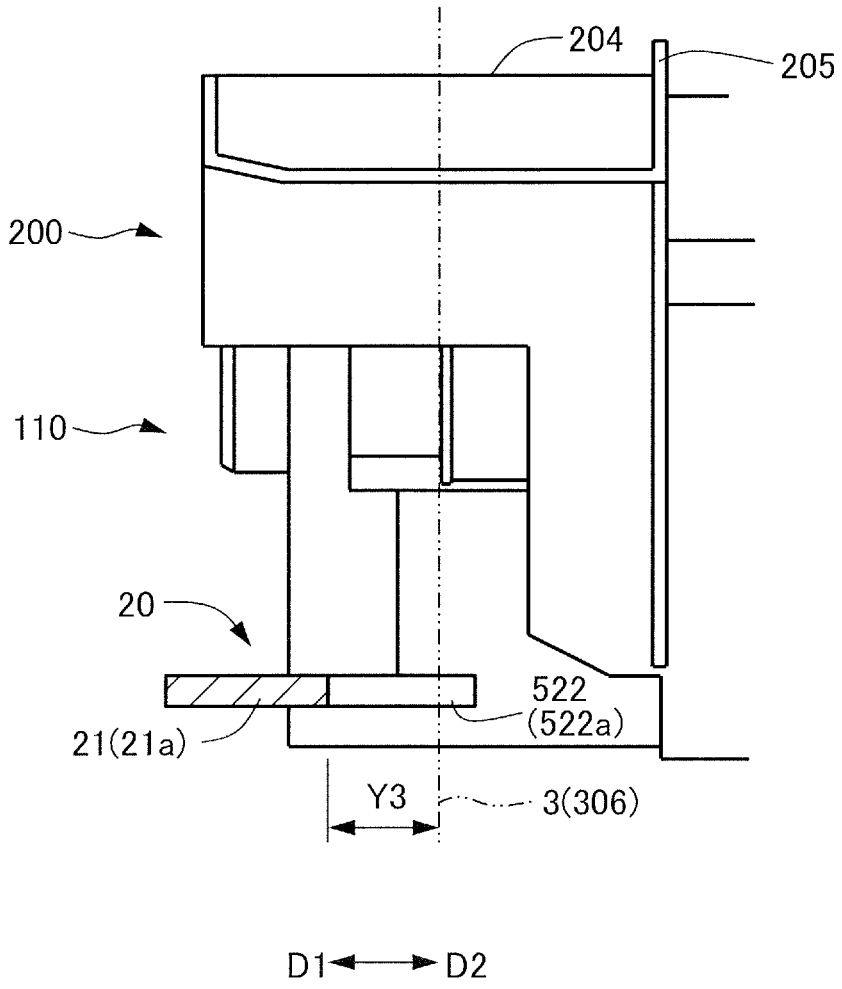
FIG. 22 is a side view illustrating a condition of the engage portion in which the drum cartridge incompatible with the apparatus body is inserted by a third distance.

For instance, as illustrated in FIG. 21, there may be a cartridge, i.e., a second drum cartridge, 110 functionally incompatible with the apparatus body 1*a* and an apparatus body, i.e., a second apparatus body, 501*a* functionally incompatible with the cartridge 100 and functionally compatible with the cartridge 110. The cartridge 100 and the cartridge 110 are identical in shape and commonly use the cover member. Still further, the second apparatus body 501*a* includes a guide rail 410 serving as a second guide portion and can guide both the cartridge 100 and the cartridge 110 inserted from a second insertion slot portion. It is noted that both of the cartridge 100 and the cartridge 110 inserted from the second insertion slot portion can be guided also by the guide rail 410 of the apparatus body 1*a*. The second apparatus body 501*a* and the cartridge 110 are provided with a second coupling for connecting a second driving source provided in the second apparatus body 501*a* with a photosensitive drum of the cartridge 110 in a case where the cartridge 110 is mounted to the second apparatus body 501*a*. The first and second couplings share at least a part. Due to that, if the cartridge 110 is entirely inserted into the apparatus body 1*a*, the coupling is coupled, thus rotating the photosensitive drum 11. The same also applies to a case where the cartridge 100 is entirely inserted into the second apparatus body 501*a*.

The cartridge 110 and the second apparatus body 501*a* are provided with a second erroneous insertion blocking portion 520. In this case, the second erroneous insertion blocking portion 520 includes a third project portion, i.e., a third portion, 521 provided in the second apparatus body 501*a* and a fourth project portion, i.e., a fourth portion, 522 provided in the cartridge 110. That is, the cartridge 110 is compatible in shape respectively with the guide rail 410 of the second apparatus body 501*a* and the guide rail 410 of the apparatus body 1*a* and is permitted to be inserted into the second apparatus body 501*a* by the second erroneous insertion blocking portion 520 of the second apparatus body 501*a*.

In forming the second apparatus body 501*a*, a first rib (corresponding to the first rib 21*a* in FIG. 15B) among two ribs of the third project portion 521 is removed by scraping or the like differing from the case of the apparatus body 1*a*. In forming the cartridge 110 functionally compatible with the second apparatus body 501*a*, a second rib (corresponding to the second rib 22*b* in FIG. 15A) facing the third project portion 521*b* that has not been removed among the two ribs of the third project portion 521 is removed by scraping or the like.

A case where the cartridge 110 is erroneously inserted into the apparatus body 1*a* will be described below. As illustrated in FIG. 22, in a case where the cartridge 110 is inserted in the insert direction D1 from the insertion slot portion 3 by the third distance Y3, the third project portion 522 of the cartridge 110 interferes with the first project portion 21 of the apparatus body 1*a*. Thereby, the cartridge 110 cannot be inserted more and cannot be mounted in the apparatus body 1*a*. As a result, it is possible to realize incompatibility of preventing erroneous insertion of inserting the cartridge 110 into the apparatus body 1*a* functionally different. That is, the erroneous insertion blocking portion 20 restricts the cartridge 110 functionally incompatible with the apparatus body 1*a* from being inserted further into the apparatus body 1*a*. That is, the erroneous insertion blocking portion 20 disables the cartridge 110 to be inserted into the apparatus body 1*a* by the third project portion 522 butting against the first project portion 21 in a case where the cartridge 110 is inserted from the insertion slot portion 3 by the third distance Y3. This arrangement makes it possible to prevent a condition in which the cartridge 110 cannot be taken out of the apparatus body 1*a* because the first project portion 21 of the erroneous insertion blocking portion 20 functions at the position apart from the insertion slot portion 3 by the third distance Y3 before when the body locking mechanism 600 becomes operative.

A case where the cartridge 100 is erroneously inserted into the second apparatus body 501*a* will be described below. In this case, the third project portion 521, i.e., the second rib 521*b*, of the second apparatus body 501*a* butts against the second project portion 22, i.e., the second rib 22*b*, of the cartridge 100, so that the cartridge 100 cannot be inserted into the second apparatus body 501*a*. This arrangement makes it possible to prevent a condition in which the cartridge 100 cannot be taken out of the second apparatus body 501*a* because the third project portion 521 of the second erroneous insertion blocking portion 520 functions at the position apart from the insertion slot portion by the third distance Y3 before when the body locking mechanism 600 becomes operative. It is noted that the cases where the erroneous insertion blocking portions 20 and 520 include the project portions in the present embodiment, shapes that interfere with each other are not limited to be the project portions. For instance, it is also possible to configure such that the erroneous insertion blocking portions 20 and 520 have grooves or the like to prevent the cartridge 100 or the cartridge 110 from being inserted into the incompatible apparatus body by passing or interfering with each other.

The image forming apparatus 1 of the present embodiment described above may be summarized as follows. That is, in the case where the cartridge 100 functionally compatible with the apparatus body 1*a* is inserted by the third distance Y3 after inserting into the apparatus body 1*a* by the guide rail 410, the erroneous insertion blocking portion 20 permits the cartridge 100 to be inserted further. Meanwhile, in the case where the cartridge 110 functionally incompatible with the apparatus body 1*a* is inserted by the third distance Y3 after inserting into the apparatus body 1*a* by the guide rail 410, the erroneous insertion blocking portion 20 restricts the cartridge 110 from being inserted further. Due to that, even if the cartridge 110 functionally incompatible with the apparatus body 1*a* is tried to be inserted by the guide rail 410, the cover member is not locked with the apparatus body 1*a*. This arrangement makes it possible to prevent the cover member from being locked by the apparatus body 1*a* in a case where the drum cartridge functionally incompatible with the apparatus body 1*a* cannot be inserted further by the erroneous insertion blocking portion 20.

Still further, according to the image forming apparatus 1 of the present embodiment, the erroneous insertion blocking portion 20 includes the first project portion 21 provided in the apparatus body 1*a* and the second project portion 22 provided in the cartridge 100. Due to that, because it is possible to prevent the erroneous insertion of the cartridge by the simple configuration, it is possible to suppress an increase of size and production costs of the apparatus. Still further, because both the first and second project portions 21 and 22 have the two ribs, it is possible to form two patterns as combinations of realizing the configurations of permitting and restricting the insertion. That is, as for the combinations of the cartridge and the apparatus body having two types of different functions, it is possible to prevent to be combined with another type.

Still further, according to the image forming apparatus 1 of the present embodiment, the cover member 200 is locked by the apparatus body 1*a* when the cartridge 100 is inserted by the first distance Y1 from the insertion slot portion 3. The cover member 200 is kept being locked by the apparatus body 1*a* until when the cartridge 100 is inserted by the second distance Y2. Therefore, the cover member 200 will not be removed out of the apparatus body 1*a* carelessly in inserting the cartridge 100, and the cartridge 100 can be mounted to the predetermined mount position while being guided and inserted by the cover member 200.

Here, in a case where the erroneous insertion blocking portion 20 is provided so as to be operative on the rear side in the insert direction D1 more than the first distance Yl, the cartridge 100 may be erroneously inserted into the apparatus body functionally incompatible with the cartridge 100 by more than the first distance Yl. In this case, there is a possibility that the body locking mechanism 600 becomes operative to the cover member 200 and the apparatus body, the body locking mechanism 600 cannot be unlocked unless the cartridge 100 is inserted into the apparatus body, and the cover member supporting the cartridge 100 cannot be taken out of the apparatus body. Meanwhile, according to the image forming apparatus 1 of the present embodiment, the relationship of the positions of the cartridge 100 from the insertion slot portion 3 is set in order of the third distance Y3, the first distance Y1 and the second distance Y2. This arrangement makes it possible to prevent the condition in which the cartridge 100 cannot be taken out of the apparatus body because the erroneous insertion blocking portion 20 becomes operative at the position apart from the insertion slot portion 3 by the third distance Y3 before when the body locking mechanism 600 which locks the cover member 200 with the apparatus body becomes operative.

Here, in a case where the cover member 200 and the apparatus body 1*a* are configured to be always unlockable, there is a possibility that the operator erroneously removes the cover member 200 out of the apparatus body 1*a* while inserting the cartridge 100. In the case where the cover member 200 is removed out of the apparatus body 1*a* while inserting the cartridge 100, the insert operation cannot be made smoothly because the cartridge 100 is not guided by the cover member 200. Meanwhile, according to the present embodiment, the second distance Y2 is set at least at the position where the center of gravity of the cartridge 100 is located in the apparatus body 1*a*. Therefore, even if the cover member 200 is unlocked from the apparatus body 1*a* in this condition, it is possible to suppress the cartridge 100 from falling out of the apparatus body 1*a*. Then, after that, the cartridge 100 can be guided by the guide rail 410 of the apparatus body 1*a*, and the insert operation can be made smoothly.

According to the image forming apparatus 1 of the present embodiment, the cover member 200 is unlocked from the cartridge 100 by disposing the cover member 200 and the cartridge 100 at the reference position. This arrangement makes it possible to unlock the cover member 200 and the cartridge 100 without making another operation.

Figure 23A:
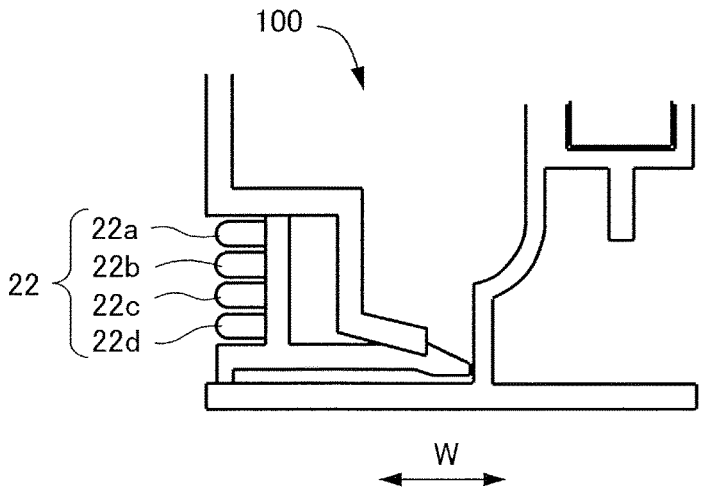
FIG. 23A is a section view illustrating the engage portion where the drum cartridge is engaged with the apparatus body before when the engage portion of the drum cartridge is processed in a modified example of the present embodiment.
Figure 23B:
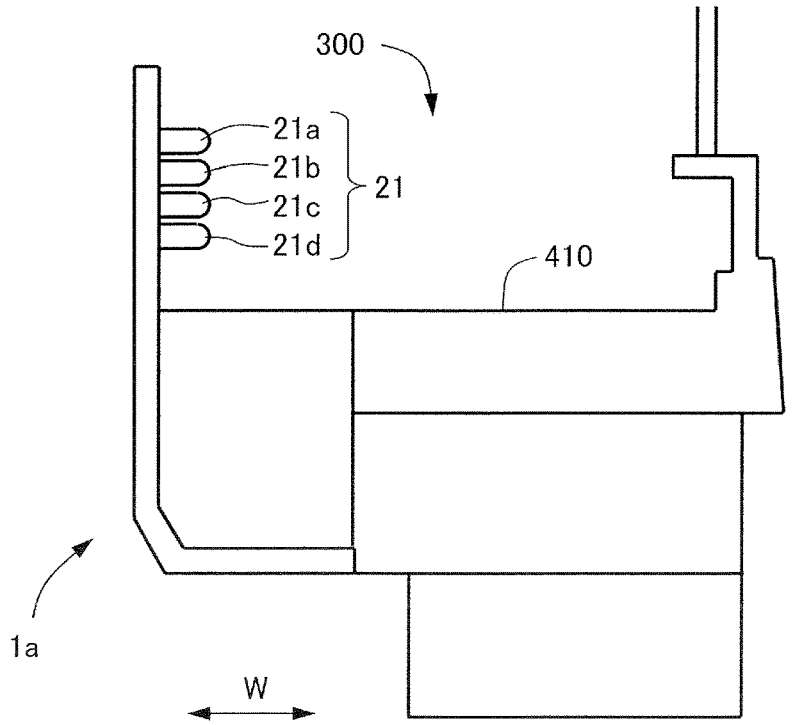
FIG. 23B is a section view illustrating the engage portion of the apparatus body.
Figure 24A:
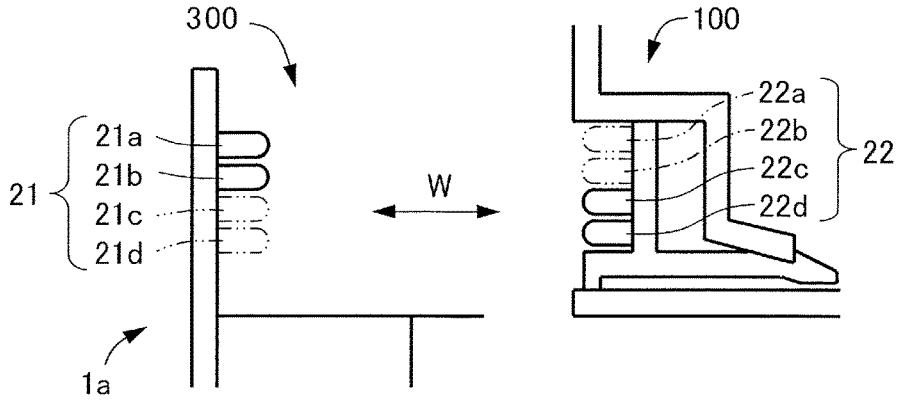
FIG. 24A is a section view illustrating a first pattern of ribs in the engage portion of the apparatus body and the drum cartridge in a modified example of the present embodiment, wherein third and fourth ribs of the first project portion and first and second ribs of the second project portion are removed.
Figure 24B:
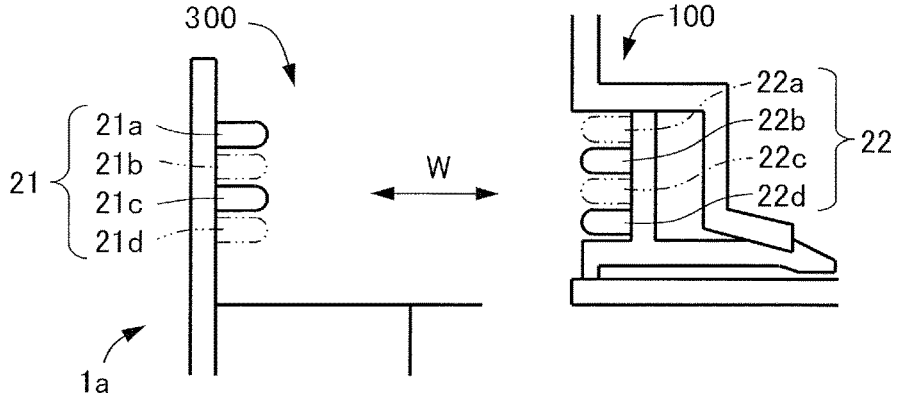
FIG. 24B is a section view illustrating a second pattern in which the second and fourth ribs of the first project portion and the first and third ribs of the second project portion are removed.
Figure 24C:
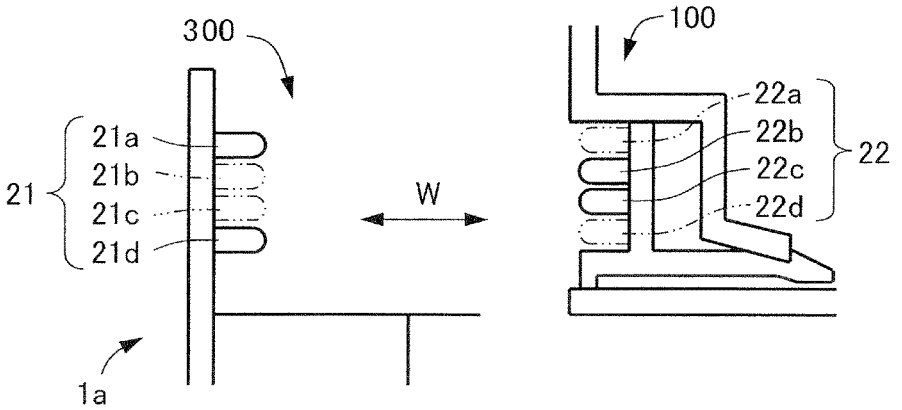
FIG. 24C is a section view illustrating a third pattern in which the second and third ribs of the first project portion and the first and fourth ribs of the second project portion are removed.
Figure 25A:
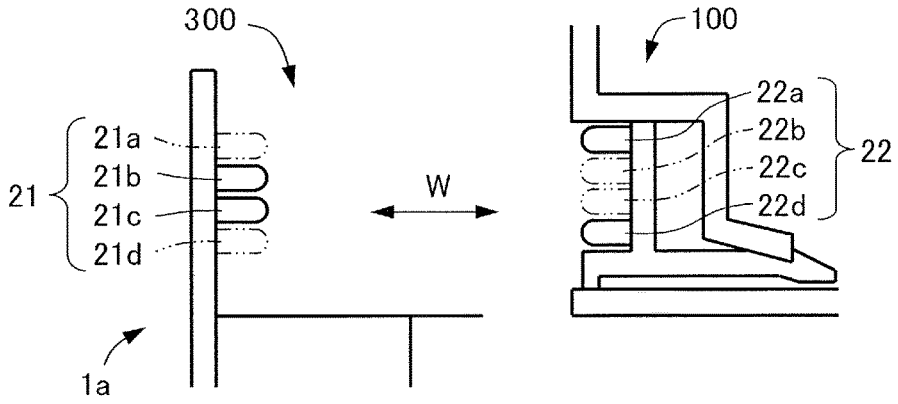
FIG. 25A is a section view illustrating a fourth pattern of ribs in the engage portion of the apparatus body and the drum cartridge in the modified example of the present embodiment, wherein the first and fourth ribs of the first project portion and the second and third ribs of the second project portion are removed.
Figure 25B:
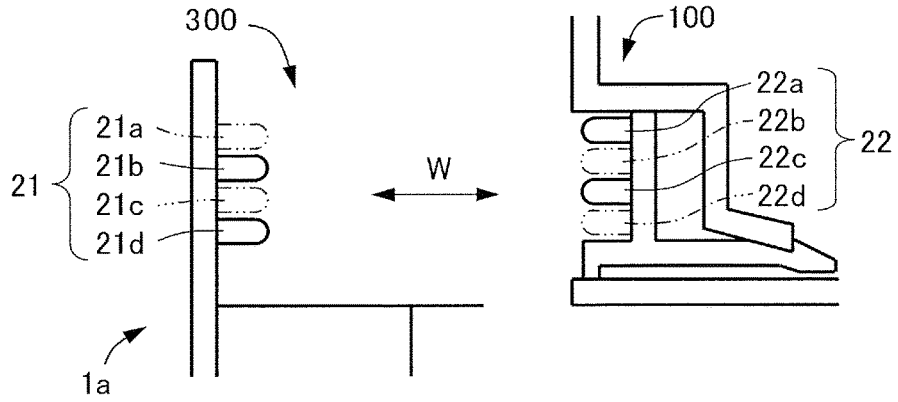
FIG. 25B is a section view illustrating a fifth pattern in which the first and third ribs of the first project portion and the second and fourth ribs of the second project portion are removed.
Figure 25C:
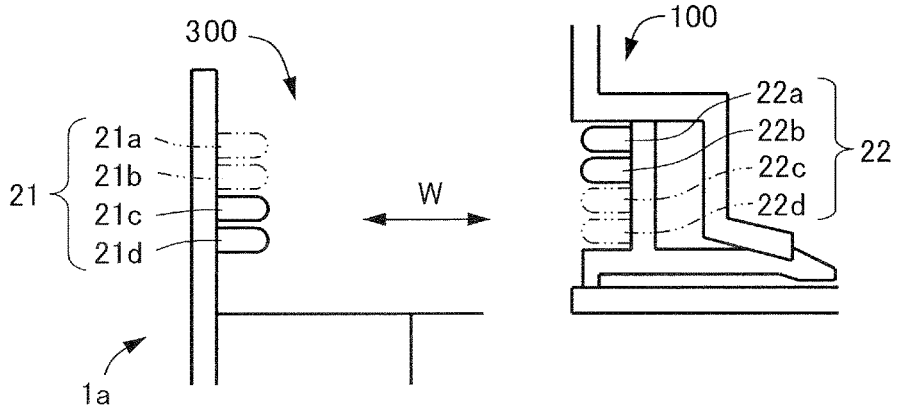
FIG. 25C is a section view illustrating a sixth pattern in which the first and second ribs of the first project portion and the third and fourth ribs of the second project portion are removed.

While the case where both the first and second project portions 21 and 22 have the two ribs has been described in the image forming apparatus 1 of the present embodiment, the present disclosure is not limited to such configuration. For instance, as illustrated in FIGS. 23A and 23B, both first and second project portions 21 and 22 may be configured to have four ribs. In this case, it is possible to configure six patterns of combination by removing two ribs among the four ribs as illustrated in FIGS. 24A through 25C. According to this configuration, it is possible to prevent a combination of another type in the combination of the cartridge and the apparatus body having six types of different functions and to share the cover member among various types of cartridges.

According to the present disclosure, in the case where a first drum cartridge functionally compatible with a first apparatus body is inserted by a third distance after inserting into the first apparatus body by being guided by a first guide portion, a first erroneous insertion blocking portion permits the first drum cartridge to be inserted further. Meanwhile, in a case where a second drum cartridge functionally incompatible with the first apparatus body is inserted by the third distance after inserting into the first apparatus body by being guided by the first guide portion, the erroneous insertion blocking portion restricts the second drum cartridge from being inserted further. Therefore, even if the second drum cartridge functionally incompatible with the first apparatus body is tried to be guided by the first guide portion and to be inserted, the second cover member is not locked by the first apparatus body. This arrangement makes it possible to prevent the cover member from being locked by the apparatus body in the case the drum cartridge functionally incompatible with the apparatus body cannot be inserted by the erroneous insertion blocking portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-110447, filed on Jun. 2, 2017, which is hereby incorporated by reference herein in its entirety.

What is claimed is:

1. A cartridge unit comprising:

a photosensitive drum having a photosensitive surface;

a cartridge body rotatably supporting the photosensitive drum;

a cover member slidably engaged with the cartridge body and configured to cover the photosensitive surface of the photosensitive drum;

an insert portion provided on the cover member, the insert portion including a shape such that the insert portion is configured to be mounted to both a first image forming apparatus that is functionally compatible with the cartridge body and a second image forming apparatus that is not functionally compatible with the cartridge body, the first image forming apparatus and the second image forming apparatus having different specifications;

a lock member provided on the cover member and configured to lock the cover member to an apparatus body of the first image forming apparatus in conjunction with sliding movement of the cartridge body to a cartridge attachment portion of the apparatus body of the first image forming apparatus; and a contact portion provided on the cartridge body and configured to contact a contacted portion of the second image forming apparatus before the lock member locks the cover member to the apparatus body of the second image forming apparatus with sliding movement of the cartridge body to a cartridge attachment portion of the apparatus body of the second image forming apparatus to which the insert portion is inserted.

2. The cartridge unit according to claim 1, wherein the cartridge body is detachably mountable to the apparatus body of the first image forming apparatus along a rotational axis direction of the photosensitive drum.

3. The cartridge unit according to claim 1, wherein the photosensitive drum is connected to a drive transmission portion of the apparatus body of the first image forming apparatus by the cartridge body being mounted to the cartridge attachment portion of the apparatus body of the first image forming apparatus.

4. The cartridge unit according to claim 1, wherein the contact portion is provided on the cartridge body at a position not covered by the cover member.

5. The cartridge unit according to claim 1, wherein the contact portion comprises a cartridge-side projecting portion projecting outside of the cartridge body and configured to contact a body-side projecting portion provided on the apparatus body of the second image forming apparatus in a case where the cartridge body is inserted to the apparatus body of the second image forming apparatus.

6. The cartridge unit according to claim 5, wherein the cartridge-side projecting portion comprises a plurality of projecting portions projecting from the cartridge body in a same direction, and wherein a project portion among the plurality of project portions that is provided at a position corresponding to a body-side projecting portion provided on the apparatus body of the first image forming apparatus is removed by scraping.

7. The cartridge unit according to claim 1, wherein the lock member comprises a projecting portion, wherein the cartridge body comprises a guide portion configured to guide the projecting portion, and wherein the lock member is configured to lock the cover member and the apparatus body of the first image forming apparatus in a condition in which the projecting portion is guided by the guide portion.

8. The cartridge unit according to claim 7, wherein the lock member integrally comprises the lock member and a lock engagement portion, the lock engagement portion being configured to lock the cover member to the apparatus body of the first image forming apparatus by the cartridge body being engaged to the apparatus body, wherein the lock member is configured to swing with respect to the cover member by linking with sliding movement of the cartridge body, and wherein the lock member is configured to be positioned at a lock position and an unlock position switchably by swinging with respect to the cover member, the lock position being a position at which the lock member locks the cover member to the apparatus body of the first image forming apparatus, and the unlock position being a position at which the lock member unlocks the cover member from the apparatus body of the first image forming apparatus.

9. An image forming apparatus comprising:

an apparatus body;

an insertion slot portion provided on the apparatus body, the insertion slot portion being to which an insert portion of a cover member and a cartridge body that is functionally compatible with the apparatus body are inserted;

a cartridge attachment portion configured to store the cartridge body, which is functionally compatible with the apparatus body, inserted through the insertion slot portion;

a cartridge body of a cartridge unit according to claim 1; and a contacted portion provided at the insertion slot portion and configured to contact the contact portion of the cartridge body that is functionally not compatible with the apparatus body in a case where the cartridge body that is functionally not compatible with the apparatus body is inserted into the insertion slot portion.

* * * * *